US007032688B2

(12) United States Patent
Kirsch

(10) Patent No.: US 7,032,688 B2
(45) Date of Patent: Apr. 25, 2006

(54) SHOCK ABSORBING VALVE FOR A PNEUMATIC TOOL

(76) Inventor: Paul Kirsch, P.O. Box 2188, Castro Valley, CA (US) 94546

( * ) Notice: Subject to any disclaimer, the term of this patent is extended or adjusted under 35 U.S.C. 154(b) by 0 days.

(21) Appl. No.: 11/183,587

(22) Filed: Jul. 18, 2005

(65) Prior Publication Data

US 2005/0247467 A1 Nov. 10, 2005

Related U.S. Application Data

(62) Division of application No. 10/725,733, filed on Dec. 2, 2003, now Pat. No. 6,932,166.

(60) Provisional application No. 60/430,611, filed on Dec. 3, 2002, provisional application No. 60/430,550, filed on Dec. 3, 2002, provisional application No. 60/430,610, filed on Dec. 3, 2002.

(51) Int. Cl.
*B25D 9/02* (2006.01)

(52) U.S. Cl. ..... 173/212; 173/206

(58) Field of Classification Search ..... 173/212, 173/206, 207, 128, 135, 2
See application file for complete search history.

(56) References Cited

U.S. PATENT DOCUMENTS

| | | | |
|---|---|---|---|
| 530,934 | A | 12/1894 | Drawbaugh |
| 3,456,744 | A | 7/1969 | Altschuler |
| 3,605,916 | A | 9/1971 | Voltsekhovsky et al. |
| 3,990,351 | A | 11/1976 | Sundin |
| 4,018,291 | A | 4/1977 | Anderson |
| 4,040,554 | A | 8/1977 | Haytayan |
| 4,308,926 | A | 1/1982 | Montabert |
| 4,363,365 | A | 12/1982 | Nikolaev et al. |
| 4,483,402 | A | 11/1984 | Vonhoff, Jr. |
| 4,484,638 | A | 11/1984 | West |
| 4,558,763 | A | 12/1985 | Montabert |
| 4,771,833 | A | 9/1988 | Honsa |
| 4,776,408 | A | 10/1988 | Elkin et al. |
| 4,846,287 | A | 7/1989 | Ericsson |
| 4,850,437 | A | 7/1989 | Sudnishnikov et al. |
| 5,002,136 | A | 3/1991 | Barthomeuf |
| 5,052,499 | A | 10/1991 | Dobry et al. |
| 5,099,926 | A | 3/1992 | Fushiya et al. |
| 5,113,950 | A | 5/1992 | Krasnoff |
| 5,210,918 | A | 5/1993 | Wozniak et al. |
| 5,277,260 | A | 1/1994 | Ranck |
| 5,322,131 | A | 6/1994 | Pressley et al. |

(Continued)

*Primary Examiner*—Scott A. Smith
(74) *Attorney, Agent, or Firm*—Howard & Howard

(57) ABSTRACT

A pneumatic tool (20) for impacting a workpiece (22) is provided. The tool (20) comprises a casing (42) defining a chamber (48). A piston (54) is slidable within the chamber (48) along an operational axis (A). An exhaust valve (100), controlled by a pilot valve (200), slides the piston (54) by selectively introducing and releasing pressurized fluid into and out from the chamber (48). A tool bit (24) is slidable within the chamber (48) to impact the workpiece (22). Kinetic energy is transferred to the tool bit (24) from the piston (54) via an impact from the piston (54) as the piston (54) slides within the chamber (48). A shock absorbing valve (500) includes a floating collar (502) that is slidable along the casing (42) between two seal rings (504). A handle (34) is mounted to the floating collar (502). The floating collar (502) reciprocates along the casing (42) as fluid envelopes (506, 508) are exposed to atmosphere in an alternating manner through exhaust ports (530, 532) in the floating collar (502) to reduce pressure in the fluid envelopes (506, 508) thereby reducing shock to a user grasping the handle (34).

21 Claims, 14 Drawing Sheets

U.S. PATENT DOCUMENTS 5,329,685 A 7/1994 Gillespie
5,419,403 A 5/1995 Klemm
5,626,457 A 5/1997 Hickman, Jr.
5,775,441 A 7/1998 Sakuragi et al.
5,806,610 A 9/1998 Sapozhnikov
5,819,857 A 10/1998 Rohrer
5,921,327 A 7/1999 Henriksson et al.
5,944,118 A 8/1999 Johansson et al.
6,112,830 A 9/2000 Ziegler et al.
6,145,727 A 11/2000 Mukoyama et al.
6,155,472 A 12/2000 Déziel
6,192,997 B1 2/2001 Tsai et al.
6,290,005 B1 9/2001 Klemm
6,364,032 B1 4/2002 DeCord, Jr. et al.
6,378,951 B1 4/2002 Bouyoucos et al.

SHOCK ABSORBING VALVE FOR A PNEUMATIC TOOL

CROSS-REFERENCE TO RELATED APPLICATIONS

This application is a divisional of application Ser. No. 10/725,733, filed on Dec. 2, 2003, now U.S. Pat. No. 6,932,166 which claims the benefit of U.S. provisional patent application Ser. No's. 60/430,611, filed Dec. 3, 2002; 60/430,550, filed Dec. 3, 2002; and 60/430,610, filed Dec. 3, 2002, all of which are herein incorporated by reference.

FIELD OF THE INVENTION

The present invention generally relates to a pneumatic tool having an impactor device, e.g., piston and tool bit, for impacting a workpiece. More specifically, the present invention relates the pneumatic tool having a shock absorbing valve for reducing shock of the pneumatic tool on a user.

BACKGROUND OF THE INVENTION

Pneumatic tools offer a "best-fit" solution in many applications because of their safety, reliability, and simplicity. Typically, however, pneumatic tools for impacting a workpiece by delivering hammering blows, e.g., pneumatic hammers, have characteristics that detract from their utility or preclude their use in some applications such as breaking off casting risers on a production line, or seating large press-fit assemblies.

A pneumatic tool for impacting a workpiece by delivering hammering blows, whether percussive or single stroke, is normally designed to produce an impact via a slidable impactor device. Typically, the impactor device comprises a tool bit that is held against a workpiece before impact and a piston for impacting the tool bit and transferring kinetic energy through the tool bit to the workpiece to perform the necessary work. The travel of the tool bit is fairly short and constrained by the workpiece. The kinetic energies developed in the impactor device are primarily absorbed by the workpiece. Any residual kinetic energies are usually small and dissipated in tool components with the help of springs or elastic pads, if necessary, to moderate the resulting forces. However, some applications, such as breaking off casting risers on a production line, require the impactor device to carry high kinetic energy throughout a relatively long stroke to impact workpieces at varying distances. Residual kinetic energies, and the forces from their dissipation, can be quite high. In these types of applications, an energy absorbing mechanism is necessary to dissipate high kinetic energies from the impactor device without the subsequent destruction of other tool components, especially in the event of a dry fire, in which the pneumatic tool is actuated with the tool bit being improperly positioned relative to the workpiece. In such an event, without an energy absorbing mechanism, tool components can be subjected to large destructive forces.

One example of such an energy absorbing mechanism in a pneumatic tool is shown in U.S. Pat. No. 6,364,032 issued to DeCord, Jr. et al. DeCord, Jr. et al. discloses a pneumatic tool having an elongated casing defining a chamber. An impactor device is slidable within the chamber along an operational axis. A valve system slides the impactor device within the chamber by selectively introducing and releasing pressurized fluid into and out from the chamber. An energy absorbing mechanism is slidably supported within the chamber for dissipating the kinetic energy of the impactor device.

The energy absorbing mechanism comprises a nylon disc and a pressure chamber between the nylon disc and a distal end of the elongated casing. A pressurization valve pressurizes the pressure chamber. The nylon disc slides against pressurized fluid in the pressure chamber upon impact by the impactor device to dissipate kinetic energy of the impactor device. The nylon disc is continuously subjected to hammering impacts from the impactor device without any prior or subsequent dissipation of kinetic energy by the energy absorbing mechanism. Thus, in the event of a dry fire, any kinetic energy in the impactor device must either be absorbed by the nylon disc and the pressurized fluid in the pressure chamber, or by other components of the tool.

BRIEF SUMMARY OF THE INVENTION AND ADVANTAGES

The present invention provides a tool for impacting a workpiece. The tool comprises a casing having a proximal end and a distal end with a chamber defined therebetween. An impactor device is slidable within the chamber along an operational axis. A valve system slides the impactor device within the chamber by selectively introducing and releasing fluid pressure into and out from the chamber. An energy absorbing mechanism reduces kinetic energy of the impactor device as the impactor device slides within the chamber. The energy absorbing mechanism comprises a sleeve that slides along the casing and first and second pressure chambers to reduce the kinetic energy of the impactor device. The first pressure chamber is defined between the impactor device and the sleeve and the second pressure chamber is defined between the casing and the sleeve. The first pressure chamber reduces the energy of the impactor device in a first stage immediately after movement thereof by compressing pressurized fluid within the first pressure chamber. The second pressure chamber reduces the energy of the impactor device in a second stage after compression in the first pressure chamber and when the impactor device impacts the sleeve.

The present invention yields several advantages over the prior art. For instance, two pressure chambers are provided to reduce the kinetic energy of the impactor device as the impactor device slides in the casing. As a result, energy dissipation occurs in at least two stages. In the first stage, the energy of the impactor device is dissipated primarily by compressing pressurized fluid in the first pressure chamber between the impactor device and the sleeve. In the second stage, after the impactor device impacts the sleeve, the energy of the impactor device is dissipated primarily by compressing pressurized fluid in the second pressure chamber. This multi-stage approach to energy dissipation using multiple pressure chambers reduces the potentially destructive hammering forces that may otherwise be experienced in a pneumatic tool such as one that absorbs kinetic energy in a single stage by directly impacting a energy absorbing component of the tool. Furthermore, the multi-stage approach to energy dissipation balances a need for smaller, more maneuverable tools with the need for high kinetic energies. Using two pressure chambers provides a more compact tool design. At the same time, the two pressure chambers prolong the kinetic energy dissipation such that the impactor device can still perform high-energy work.

BRIEF DESCRIPTION OF THE SEVERAL VIEWS OF THE DRAWINGS

Advantages of the present invention will be readily appreciated as the same becomes better understood by reference to the following detailed description when considered in connection with the accompanying drawings wherein.

DETAILED DESCRIPTION OF THE INVENTION

Referring to the Figures, wherein like numerals indicate like or corresponding parts throughout the several views, a tool for impacting a workpiece 22 is generally shown at 20. The tool 20 is preferably a pneumatic impacting tool for fracturing a gate or riser from a casting after a foundry pouring process. Of course, the tool 20 may be used for other applications including, but not limited to, breaking concrete or other similar demolition, driving fasteners in construction applications, seating large press-fit assemblies, and the like. The tool 20 is powered by a conventional pressurized fluid source IF, e.g., an air compressor.

Figure 1:
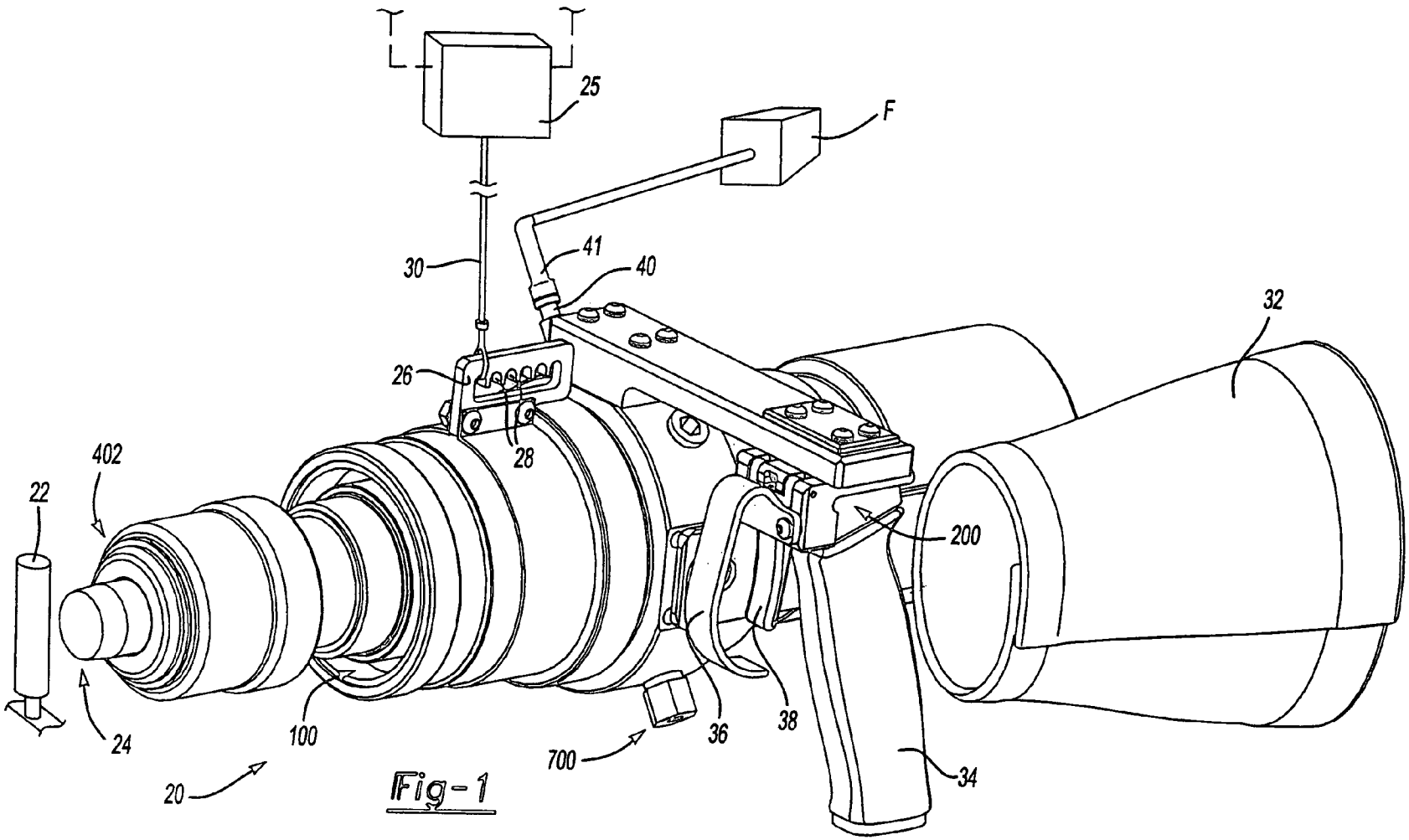
FIG. 1 is a perspective view of a tool of the present invention.

Referring to FIG. 1, the tool 20 is shown fully assembled and ready for use. A tool bit 24 is shown in a starting position. Upon actuation, the tool bit 24 slides distally to impact the workpiece 22. An adjuster plate 26 may be used to suspend the tool 20 from a tool balancer 25 to provide added versatility and maneuverability in positioning the tool bit 24 adjacent to the workpiece 22. The adjuster plate 26 includes a plurality of slots 28 for adjustably receiving a cable 30 of the tool balancer. The slots 28 allow the operator to adjust a balance point and associated weight distribution of the tool 20 for added comfort and maneuverability.

The tool 20 further comprises a cuff 32 having hook and latch fasteners (not shown) for adjustably and comfortably receiving an arm of an operator. A handle 34 is used to grip and maneuver the tool 20 to position the tool bit 24 in necessary proximity to the workpiece 22. A hand guard 36 protects a hand of the operator. A trigger 38 is pivotally supported near the handle 34 to actuate the tool 20 and drive the tool bit 24 toward the workpiece 22. The tool 20 also includes a conventional inlet 40 for receiving a quick connect coupler 41 from the pressurized fluid source F to power the tool 20.

Figure 2A:
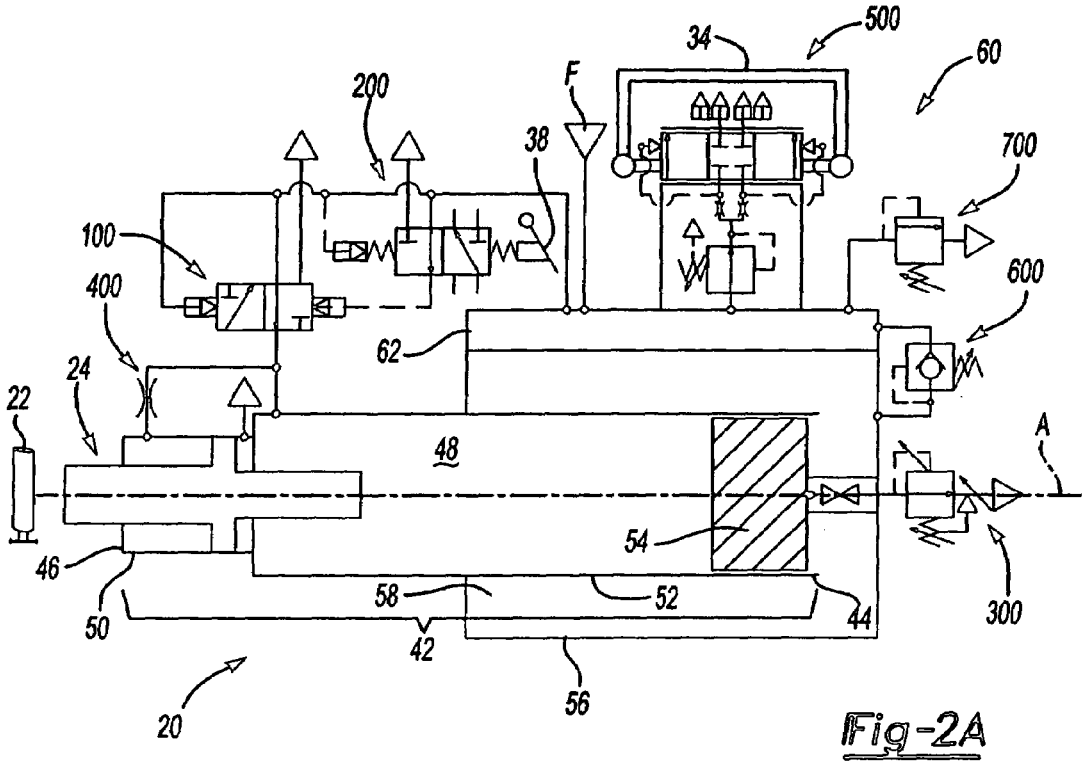
FIGS. 2A–2B are schematic illustrations of the tool of the present invention in an un-actuated and an actuated stage, respectively.
Figure 2B:
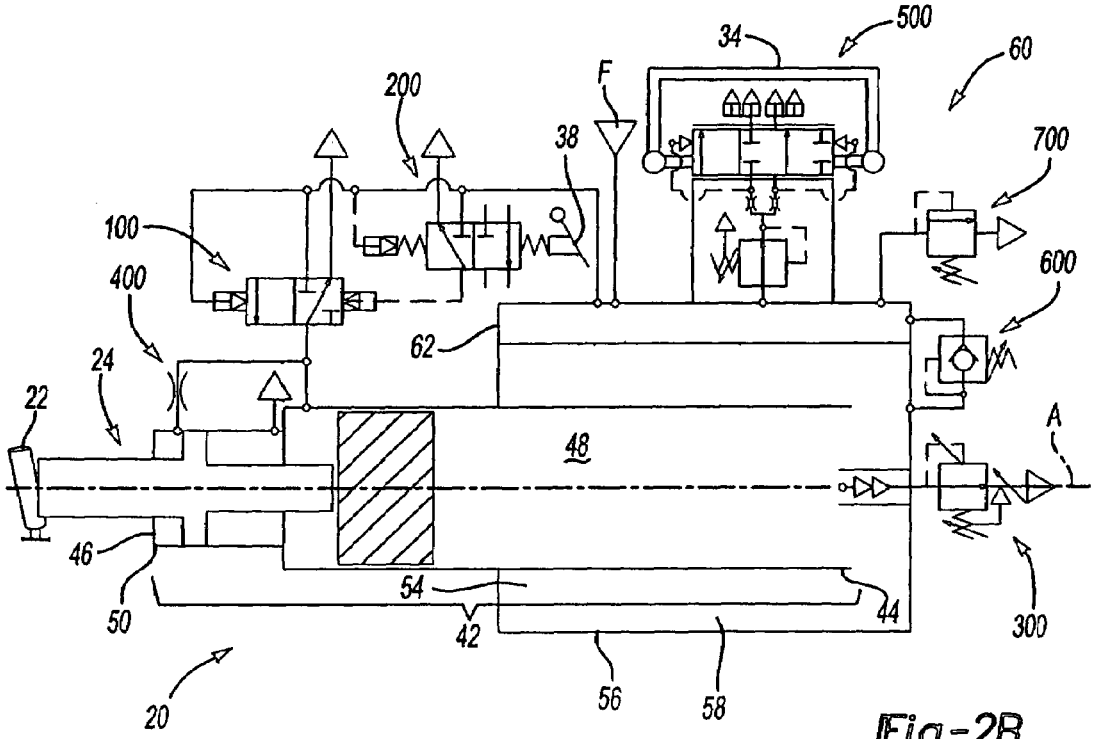

Referring to FIGS. 2A–2B, the tool 20 and corresponding fluid circuitry are schematically illustrated. FIG. 2A illustrates the tool 20 in an un-actuated position, e.g., prior to pulling the trigger 38. The tool 20 comprises a casing 42 having a proximal end 44 and a distal end 46. A chamber 48 is defined within the casing 42 between the ends. The casing 42 comprises a tool barrel 50 for slidably and concentrically sealing and supporting the tool bit 24 and a power barrel 52 for slidably and concentrically sealing and supporting a piston 54. The tool bit 24 and piston 54 define an impactor device 24, 54 of the tool 20. The piston 54 slides distally within the power barrel 52 along an operational axis A upon actuation to impact the tool bit 24 and drive the tool bit 24 toward the workpiece 22. FIG. 2B illustrates the tool 20 in an actuated position, e.g., after pulling the trigger 38.

Still referring to FIGS. 2A–2B, an outer casing 56 coaxially and concentrically surrounds the power barrel 52. A reserve chamber 58 is defined between the outer casing 56 and the power barrel 52. In the reserve chamber 58, pressurized fluid is detained to drive the piston 54 distally within the chamber 48. As will be described further below, the fluid in the chamber 48 distal to the piston 54 is at a first pressure in the un-actuated position, see FIG. 2A, while the fluid in the reserve chamber 58 is at a second pressure less than the first pressure. This pressure differential latches the piston 54 to the proximal end 44 of the casing 42 in the un-actuated position. Upon actuation, the fluid in the chamber 48 distal to the piston 54 is quickly exposed to atmosphere thus thrusting the piston 54 distally to impact the tool bit 24.

A valve system 60 controls the actuation of the piston 54 and a piston return cycle, i.e., return of the piston 54 back to the un-actuated position. The valve system 60 comprises a plurality of valves for operating various aspects of the tool 20. The circuitry of each of the valves is schematically illustrated in FIGS. 2A–2B. It will be appreciated by those skilled in the art, that the manner of carrying out the circuitry illustrated is unlimited. The circuits illustrated could be carried out by simple flexible conduit connections, fluid passages contained in outer casings or cylinders of the tool 20, or other alternative methods. In FIG. 1, the tool 20 is shown with additional casings and cylinders to carry out the fluid circuitry schematically illustrated in FIGS. 2A–2B.

A distribution manifold 62 distributes the pressurized fluid from the pressurized fluid source F to the valve system 60, as shown in FIGS. 2A–2B. The fluid routing from the distribution manifold 62 throughout the tool 20 is illustrated using conventional symbols well known to those skilled in the art. Hence, a description of each of the symbols and the specific circuitry for each of the valves will not be further described except with respect to the structure illustrated herein for fluid routing.

An exhaust valve, schematically represented at 100, controls the selective introduction and release of pressurized fluid into and out from the chamber 48 distally of the piston 54 to hold the piston 54 in the un-actuated position and to release the piston 54 upon actuation, respectively. The exhaust valve 100 is a tight-sealing, two-position, three-way piloted valve effecting an abrupt, very high flow exhaustion of the chamber 48 of the pressurized fluid upon actuation. In a closed position, the exhaust valve 100 reintroduces pressurized fluid into the chamber 48 to push back and latch the piston 54 to the proximal end 44 against pressurized fluid in the reserve chamber 58. When actuated, the exhaust valve 100 will cause a very rapid acceleration of the piston 54 to produce a high-energy impact against the tool bit 24.

A pilot valve, schematically represented at 200, controls the exhaust valve 100. The pilot valve 200 is a tight-sealing, three-way piloted valve designed to produce a sudden actuation of the tool 20 via an abrupt exhaust cycle. The trigger 38 actuates the pilot valve 200 to produce a conventional "on/off" feel, though other means can be used.

A bleeder valve, schematically represented at 300, bleeds pressurized fluid from within the chamber 48 proximal of the piston 54 to assist in drawing the piston 54 back to the proximal end 44 in the piston return cycle. The bleeder valve 300 is a tight-sealing, variable flow-rate, sequencing on-off bleeder exhaust valve piloted by the opening of a source of pressurized fluid to be vented. The bleeder valve 300 actuates after a delay and at a cracking pressure, both of which can be adjusted. The bleeder valve 300 can be used to lower the pressure proximally of the piston 54 in the chamber 48 to enable the piston return cycle with minimal air loss and with variable cyclic rate. The bleeder valve 300 responds to a position of the piston 54 in the chamber 48 and requires no connection to any other valve. The bleeder valve 300 enables a length of the casing 42 to be varied with no revision of other valve circuitry.

A restrictor orifice, schematically represented at 400, is in fluid communication with the chamber 48 to assist in absorbing energy of the tool bit 24 upon actuation and to return the tool bit 24 to the starting position after actuation. The restrictor orifice 400 is part of an energy absorbing mechanism 402 of the tool 20, as will be further described below.

A shock absorbing valve, schematically represented at 500, reduces shock to the operator caused by the energy being transferred between components of the tool 20 and the workpiece 22 and vice versa. The shock absorbing valve 500 dissipates recoil shock from the tool 20 via compression and release of pressurized fluid. The shock absorbing valve 500 is integrated into the tool 20 to reduce the transmission of potentially bothersome or injurious shock to the operator.

A pressure reducing check valve, schematically represented at 600, reduces the pressure of fluid between the distribution manifold 62 and the reserve chamber 58 such that the pressure of the fluid in the reserve chamber 58 is slightly less than that of the pressure of the pressurized fluid source F, e.g., one to twenty pounds per square inch less pressure.

A pressure relief valve is schematically represented at 700 in FIGS. 2A–2B. The pressure relief valve 700 is shown extending from an underside of the tool 20 in FIG. 1 to relieve pressure within the tool 20 when the pressure exceeds a predetermined limit.

Figure 3:
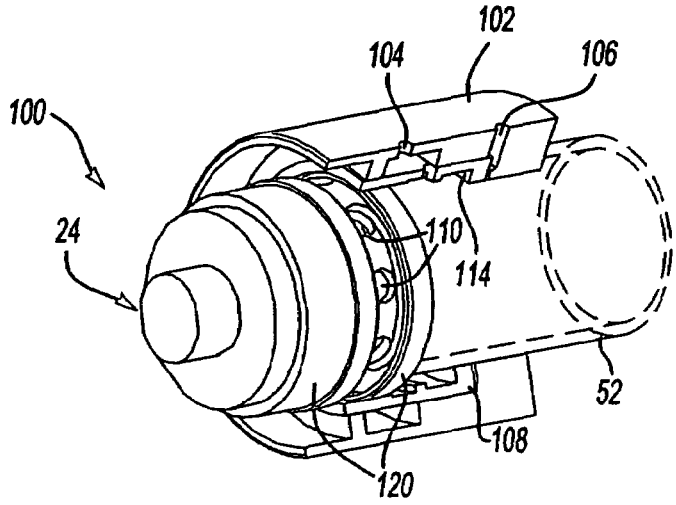
FIG. 3 is a perspective view of an exhaust valve of the present invention.

With reference to FIGS. 3 and 4A–4D, the exhaust valve 100 is further described. The exhaust valve 100 comprises a valve housing 102 concentrically fixed to the power barrel 52. The valve housing 102 acts as a manifold to distribute pressurized fluid appropriately to actuate the exhaust valve 100. As shown in FIG. 3, a first port 104 is defined in the valve housing 102. The first port 104 receives pressurized fluid directly from the distribution manifold 62. See FIGS. 2A–2B. Thus, there is a constant source of pressurized fluid entering the first port 104. A second port 106 is defined in the valve housing 102 adjacent to the first port 104. The second port 106 is in operative communication with the pilot valve 200 such that the pilot valve 200 controls the flow of pressurized fluid into and out from the second port 106. The selective introduction of pressurized fluid into and out from the second port 106 controls movement of a sliding sleeve 108.

Figure 4A:
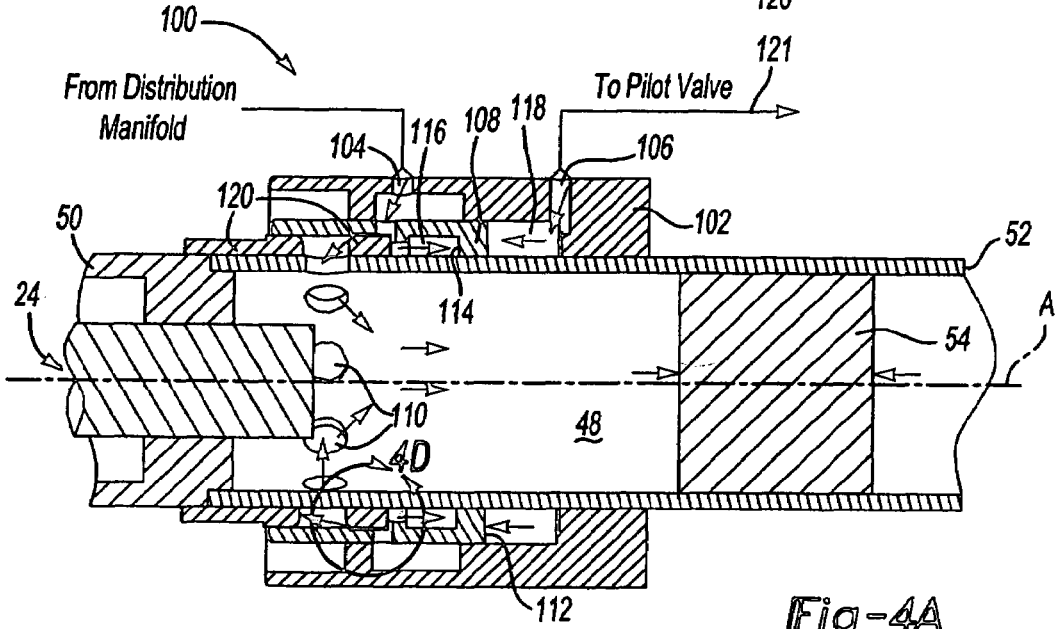
FIGS. 4A–4C are cross-sectional views of the exhaust valve illustrating three stages of the exhaust valve.

In an initial stage, illustrated in FIG. 4A, the sliding sleeve 108 covers a plurality of ports 110 defined and spaced annularly about the power barrel 52. In this stage, the pilot valve 200 is in a ready or initial position, i.e., the trigger 38 has not been pulled. Thus, the first 104 and second 106 ports both receive pressurized fluid at generally the same pressure. However, since an area of a proximal annular surface 112 of the sliding sleeve 108 operative with the second port 106 is greater than an area of a distal annular surface 114 of the sliding sleeve 108 operative with first port 104, the sliding sleeve 108 is biased in a closed position to cover the plurality of ports 110. Arrows are used throughout the Figures to indicate fluid flow in each of the stages illustrated for each of the valves.

First 116 and second 118 fluid envelopes, in operative communication with the first 104 and second 106 ports, provide access to the annular surfaces 112, 114 of the sliding sleeve 108. Seal rings 120 that are concentrically fixed to the power barrel 52 both proximally and distally of the plurality of ports 110 create this configuration. The sliding sleeve 108 slides across the seal rings 120 to cover and uncover the plurality of ports 110. The valve housing 102, power barrel 52, seal rings 120, and sliding sleeve 108 are sized and configured so as to permit relatively free motion of the sliding sleeve 108 while maintaining integrity of the sealing method employed. The sliding sleeve 108 should be formed from lightweight material to minimize inertia. In addition, a flow capacity of a fluid circuit 121 between the second envelope 118 and the pilot valve 200 is equal to or slightly greater than a flow capacity of the pilot valve 200 to minimize flow time.

Figure 4B:
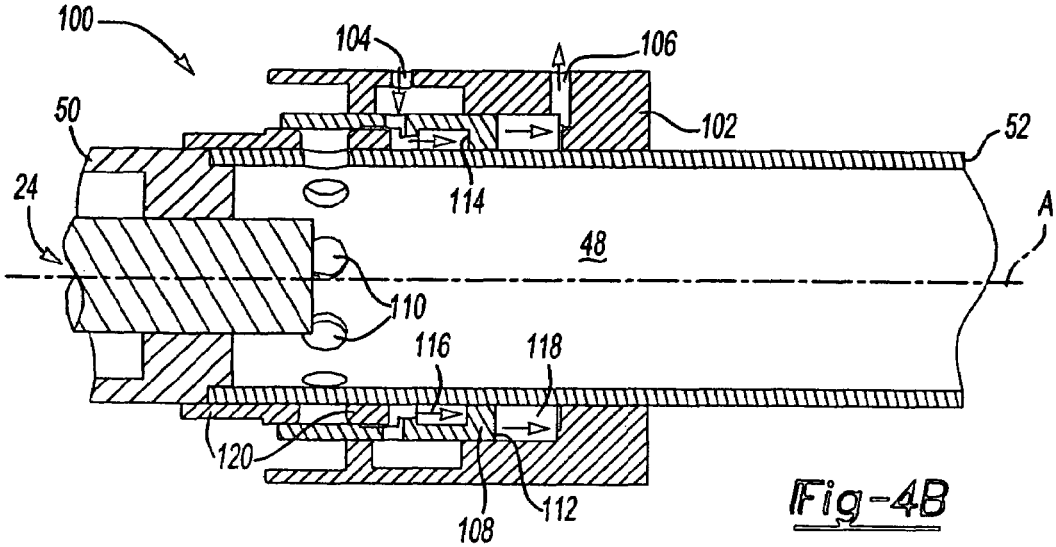
Figure 4C:
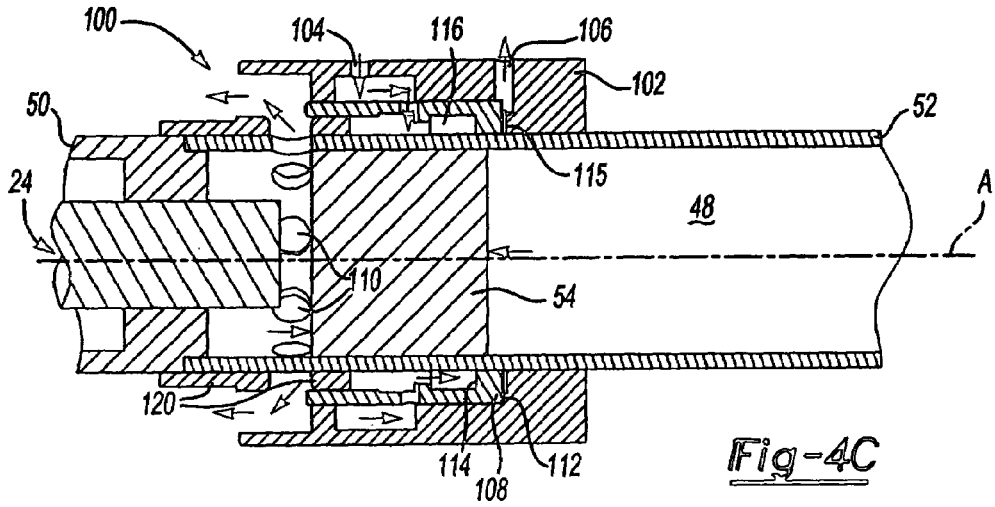
Figure 4D:
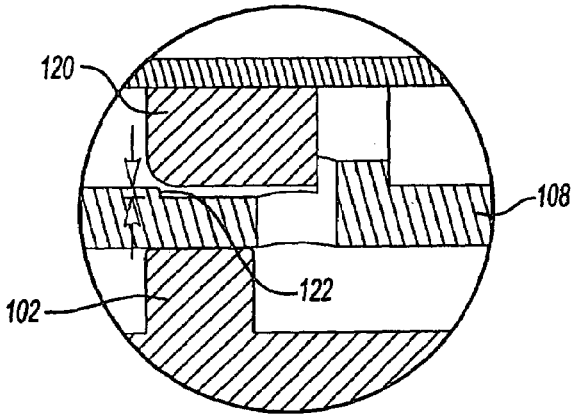
FIG. 4D is a blown-up view of an air groove in a sliding sleeve of the exhaust valve.

Referring briefly to FIG. 4D, in the initial stage, pressurized fluid is also introduced into the chamber 48 distally of the piston 54 to return or maintain the piston 54 in the un-actuated position. An air groove 122 in the sliding sleeve 108 permits the movement of the pressurized fluid from the first port 104 into the chamber 48 through the ports 110.

In a second stage, illustrated in FIG. 4B, the trigger 38 has been pulled and pressurized fluid is released out from the second port 106. As will be described further below, the second port 106 is exposed to atmospheric pressure via the pilot valve 200. When this transition in fluid flow occurs, the fluid pressure provided by the second port 106 across the proximal annular surface 112 of the sliding sleeve 108 is removed and the sliding sleeve 108 slides proximally due to the continued pressure on the distal annular surface 114 provided by the first port 104. In this stage, the piston 54 is latched to the proximal end 44 in the un-actuated position.

In the final stage, illustrated in FIG. 4C, the sliding sleeve 108 is fully retracted to uncover the plurality of ports 110 in the power barrel 52. The ports 110 are exposed directly to the atmosphere and due to the pressure differential across the piston 54, as previously described, the piston 54 travels ferociously toward the tool bit 24 from the proximal end 44 to impact the tool bit 24 and drive the tool bit 24 toward the workpiece 22. When the trigger 38 is released, pressurized fluid is again directed into the second port 106 behind the proximal annular surface 112 to slide the sliding sleeve 108 back across the plurality of ports 110, as illustrated in the initial stage of FIG. 4A. An air gap 115 remains behind the proximal annular surface 112 even when the sliding sleeve 108 is fully retracted. This ensures that the sliding sleeve 108 can be returned to an extended position to cover the ports 110 after actuation.

With reference to FIGS. 5A–5D, the pilot valve 200 is further described. The pilot valve 200 comprises a valve housing 202 defining a pilot chamber 204. The valve housing 202 may comprise two sealed portions, as shown, or may comprise a single unitary piece. A plunger 206 is slidably and concentrically supported within the pilot chamber 204 to actuate the pilot valve 200 and control the exhaust valve 100. The trigger 38 slides the plunger 206 within the pilot chamber 204. A first port 208 is in continuous fluid communication with the distribution manifold 62. See FIGS. 2A–2B. Thus the first port 208 is in continuous communication with the pressurized fluid source F. A second port 210 is in direct fluid communication with the second port 106 of the exhaust valve 100. A third port 212 exposes the pilot chamber 204 to the atmosphere.

The plunger 206 includes first 214, second 218, and third 228 annular seals to selectively seal and unseal portions of the pilot chamber 204 to control the exhaust valve 100. A spring 216 is retained at an intermediate position on the plunger 206 and coaxially surrounds the plunger 206. The spring 216 biases the first annular seal 214 against a shoulder 220 of the plunger 206. Linear displacement of the plunger 206 progressively closes the first port 208 and compresses the spring 216 to snap the first annular seal 214 off of a poppet seat 222 to abruptly open fluid communication between the second 210 and third 212 ports. The valve has a very sudden one-way transition characteristic once the actuation cycle passes a threshold, similar to the action of a toggled light switch.

Figure 5A:
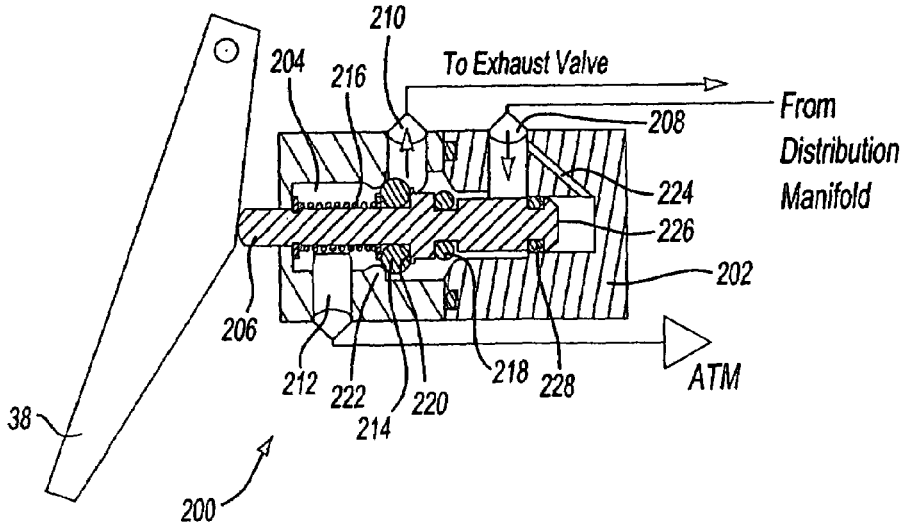
FIGS. 5A–5D are cross-sectional views of a pilot valve of the present invention illustrating four stages of the pilot valve.

In an initial stage, referring to FIG. 5A, the plunger 206 is at an initial, un-actuated position. In this position the first annular seal 214 is sealed against the poppet seat 222 and pressurized fluid from the distribution manifold 62 is routed through the first port 208 into the second port 210 and to the exhaust valve 100. As previously described, in this stage, the pressurized fluid is introduced into the chamber 48 distally of the piston 54 to latch the piston 54 to the proximal end 44 of the casing 42. A narrow angled passage 224 provides pressurized fluid behind a chamfered end 226 of the plunger 206 to bias the plunger 206 toward the trigger 38. Furthermore, in the initial stage, the third port 212 is closed to fluid communication with the first 208 and second 210 ports via the first annular seal 214.

Figure 5B:
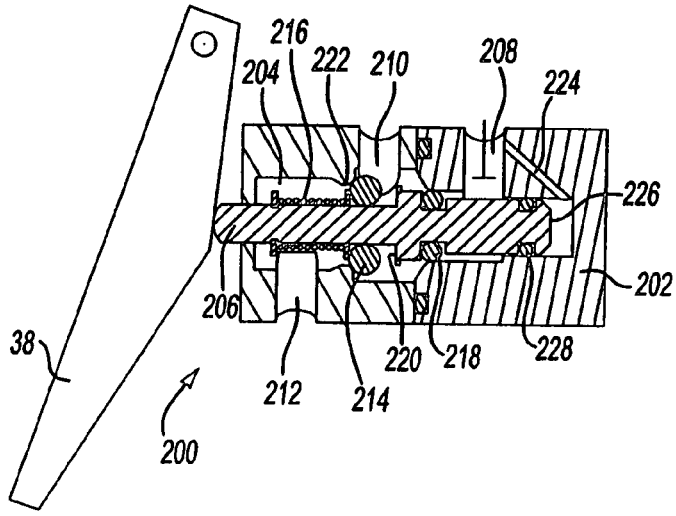
Figure 5C:
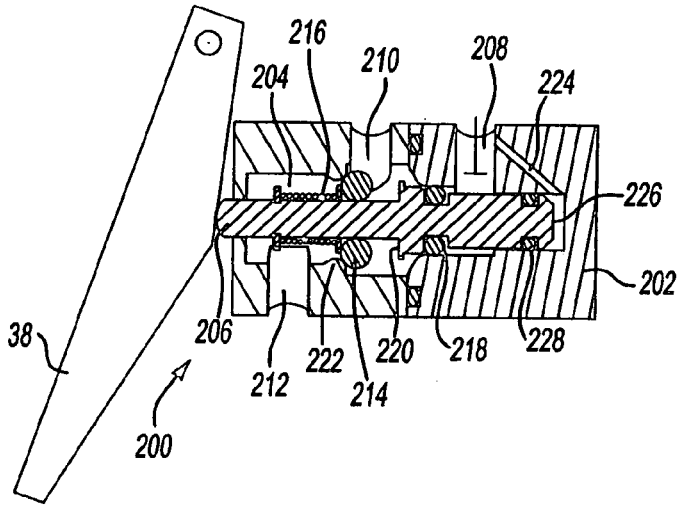

In a second and third stage, illustrated in FIGS. 5B and 5C, respectively, the plunger 206 is depressed by the trigger 38 and the second annular seal 218 closes fluid communication between the first 208 and second 210 ports. In these stages, the spring 216 begins to compress and a biasing force of the spring 216 continues to urge the first annular seal 214 away from the poppet seat 222.

Figure 5D:
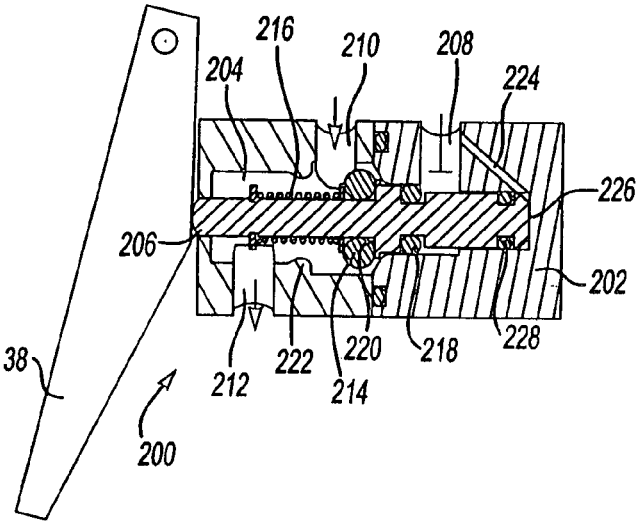

In a final, actuated stage, illustrated in FIG. 5D, the plunger 206 is fully depressed in the pilot chamber 204 and under the biasing force of the spring 216, the first annular seal 214 unseats from the poppet seat 222 and slides back to the shoulder 220. This action opens fluid communication between the second 210 and third 212 ports thus releasing the pressurized fluid from the second port 106 of the exhaust valve 100 to the atmosphere, as previously described, causing the sliding sleeve 108 to open the ports 110 in the power barrel 52 resulting in a sudden thrust of the piston 54 against the tool bit 24.

With reference to FIGS. 6A–6C and 7–8, the bleeder valve 300 is further described. The bleeder valve 300 includes a valve housing 302 sealed to the proximal end 44 of the power barrel 52. Thus the valve housing 302 acts as an end cap of the power barrel 52. The valve housing 302 defines an annular envelope 304 concentric with the power barrel 52. A variable capacity fluid passage 306 extends between the annular envelope 304 and the atmosphere. A timing screw 308 is adjustably positioned in the valve housing 302 to vary the capacity of the variable capacity fluid passage 306. Adjusting the timing screw 308 controls the timing of the bleeder valve 300. The valve housing 302 also defines a first port 310 in fluid communication with the chamber 48 when the piston 54 moves distally from the valve housing 302 within the chamber 48 upon actuation.

A poppet body 312 provides fluid communication between the first port 310 and the annular envelope 304 to bleed pressurized fluid from the chamber 48 to the atmosphere. The timing screw 308 adjusts this bleed rate to adjust a cracking rate of the poppet body 312 as further described below. The poppet body 312 is slidably and concentrically sealed within a rear cavity 314 of the valve housing 302. The poppet body 312 is lightweight and includes first 316 and second 318 grooves (see FIG. 8) for first 320 and second 322 seals. The poppet body 312 defines first 324 and second 326 narrow passages and a plurality of ports 328 for fluid flow. The poppet body 312 is preferably formed from a low-friction, non-corroding material, e.g., acetal, to minimize inertial and frictional latency. A spring plug 330 is retained via a retainer clip 332 within the rear cavity 314 of the valve housing 302 proximally to the poppet body 312. A spring 334 is seated in the spring plug 330 to bias the poppet body 312 into the first port 310 of the valve housing 302. A spring screw 336 adjusts the biasing force of the spring 334 on the poppet body 312 to adjust a cracking pressure of the poppet body 312.

Figure 6A:
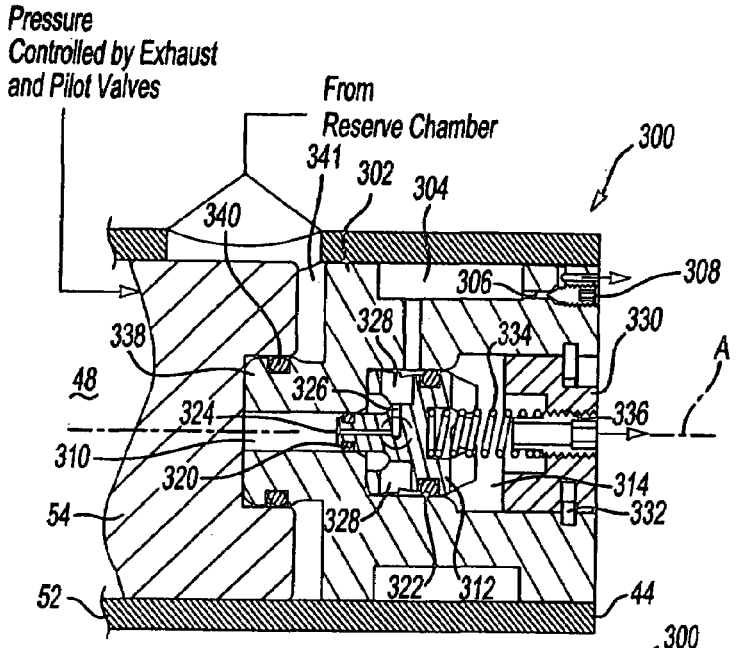
FIGS. 6A–6C are cross-sectional views of a bleeder valve of the present invention illustrating three stages of the bleeder valve.

In an initial stage, illustrated in FIG. 6A, the bleeder valve 300 remains closed while the piston 54 remains seated against a seat 338 and seal 340 of the valve housing 302, thus sealing pressurized fluid from the bleeder valve 300. The bleeder valve 300 also remains closed during a delay period after the piston 54 accelerates forward upon actuation. In this stage, the chamber 48 is fully pressurized, i.e., the exhaust valve 100 is closed. A space 341 provides fluid access from the reserve chamber 58 proximally of the piston 54. A port is defined in the power barrel 52 to feed pressurized fluid from the reserve chamber 58 to the space 341. The reserve chamber 58 continuously provides pressurized fluid proximally of the piston 54 at a pressure less than the pressurized fluid source F, as previously described.

Figure 6B:
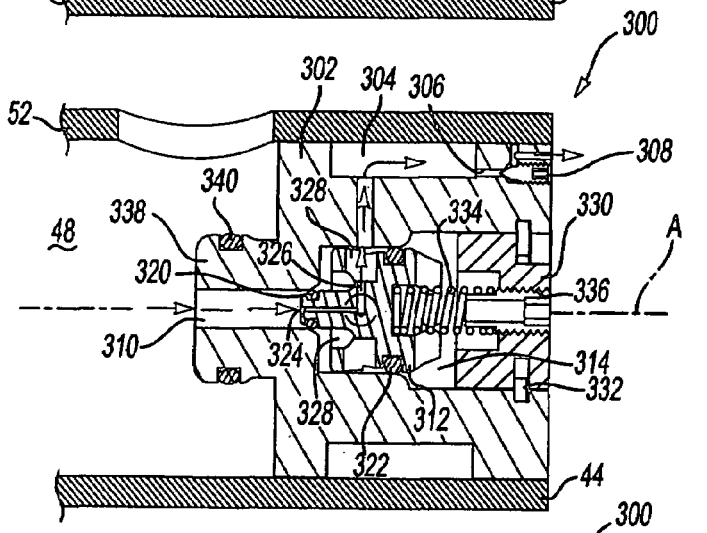

In a second stage, illustrated in FIG. 6B, the tool 20 has been actuated and the piston 54 has slid distally within the chamber 48. This exposes the bleeder valve 300 to the pressurized fluid provided by the reserve chamber 58 behind or proximally to the piston 54. Exposure of the bleeder valve 300 to pressurized fluid begins a timing sequence to crack the poppet body 312 after a predetermined delay, as controlled by the timing screw 308. Prior to the poppet body 312 cracking, the poppet body 312 begins to compress the spring 334 and displace the seals 320 and 322. This occurs as pressure builds on the poppet body 312 from the first port 310 and the annular envelope 304. Ultimately, the poppet body 312 yields to the pressure from the annular envelope 304 to crack the poppet body 312. The rate of pressure build-up in the annular envelope 304 is controlled by the timing screw 308 and the associated rate of release of pressurized fluid to the atmosphere via the variable capacity fluid passage 306. Upon cracking, the poppet body 312 accelerates quickly to create a pressure drop to enable the piston return cycle. FIG. 6B illustrates the poppet body 312 immediately before cracking.

Figure 6C:
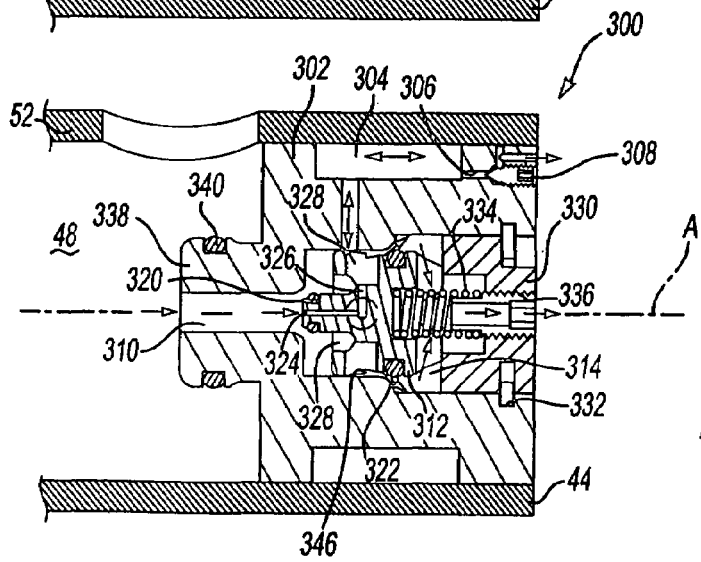
Figure 7:
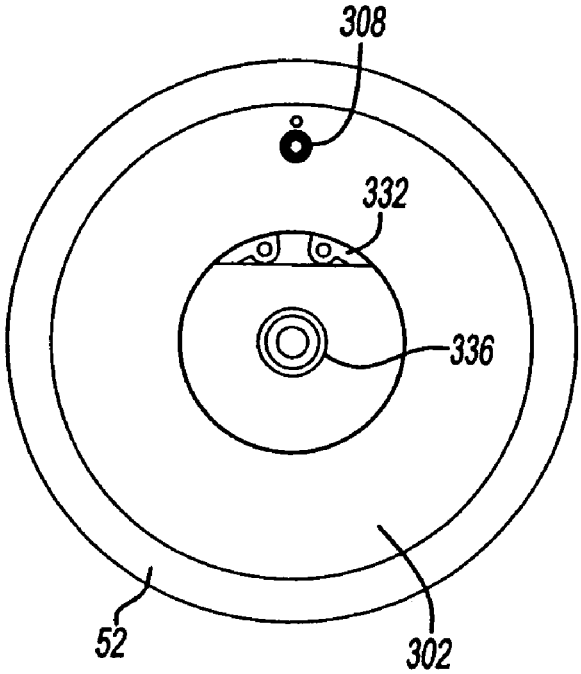
FIG. 7 is an end elevational view of the tool indicating a location of the bleeder valve.
Figure 8:
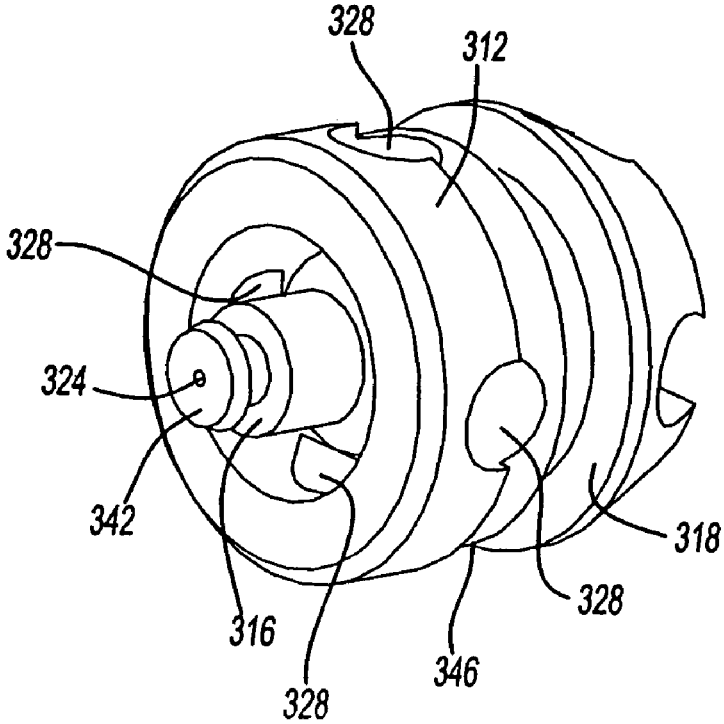
FIG. 8 is a perspective view of a poppet body of the bleeder valve.

In a final stage, illustrated in FIG. 6C, the bleeder valve 300 is fully opened to more rapidly expel the pressurized fluid provided by the reserve chamber 58 to the atmosphere to enable the piston return cycle. In this stage, pressurized fluid in the chamber 48 passes to the atmosphere through the spring plug 330. Here, a nose 342 (see FIG. 8) of the poppet body 312 is withdrawn from the first port 310, exposing an entire cross-section of the poppet body 312 to the pressurized fluid, which thrusts the second seal 322 of the poppet body 312 beyond a seat thereof, opening flow passages between the seat and an air groove 346 of the poppet body 312. This is the cracking of the poppet body 312 as described above. The open flow position of the poppet body 312 is controlled by a balance between a flow-induced pressure drop and a setting of the spring 334. The variable control of the bleeder valve 300 allows the piston 54 to return back to the seat 338 at a desired rate.

With reference to FIGS. 9A–9C, 10A–10C, and 11–12, the energy absorbing mechanism 402 is described. Kinetic energy is transferred from the piston 54 upon actuation to the tool bit 24 by one or more elastic collisions. This kinetic energy is dissipated by collision of the tool bit 24 with the workpiece 22 (not shown in FIGS. 9A–9C and 10A–10C) and/or by a secondary series of elastic collisions along with a multi-stage compression and release of pressurized fluid through the restrictor orifice 400. The energy absorbing mechanism 402 ensures that in the event the tool bit 24 misses the workpiece 22, e.g., during a dry fire, the kinetic energy is safely dissipated.

The energy absorbing mechanism 402 comprises a sleeve 404 concentrically and sealably supported by the tool barrel 50. The sleeve 404 is slidable along the tool barrel 50. In particular, the sleeve 404 has a proximal end 401 including an annular sealing ring 403 fixed thereto for slidably sealing the sleeve 404 to an outer surface of the tool barrel 50. The sleeve 404 also includes a distal end 405 having a main body 407 defining an orifice for receiving the tool bit 24. A first annular wall 406 extends coaxially and proximally from the main body 407 into the tool barrel 50. A second annular wall 408 is coaxially spaced from the first annular wall 406 and extends coaxially and proximally from the main body 407 about the outer surface of the tool barrel 50. An annular groove is defined between the annular walls 406, 408 and the tool barrel 50 slides within the annular groove as the sleeve 404 slides along the tool barrel 50.

A first pressure chamber 412 is defined between the tool bit 24, the tool barrel 50, and the first annular wall 406 of the sleeve 404. Pressurized fluid in the first pressure chamber 412 begins to reduce the kinetic energy of the tool bit 24 immediately after impact by the piston 54. A second pressure chamber 414 is defined between the outer surface of the tool barrel 50, a flange 411 of the tool barrel, the annular sealing ring 403, and the second annular wall 408 of the sleeve 404. Thus, the first 412 and second 414 pressure chambers are radially offset from one another relative to the operational axis A. Pressurized fluid in the second pressure chamber 414 reduces the kinetic energy of the tool bit 24 immediately after impact of the sleeve 404 by the tool bit 24. Thus, the dissipation of the kinetic energy occurs in multiple stages. One of which includes the compression of fluid within the first pressure chamber 412, while another includes the compression of fluid within the second pressure chamber 414.

Figures 9A, 9B:
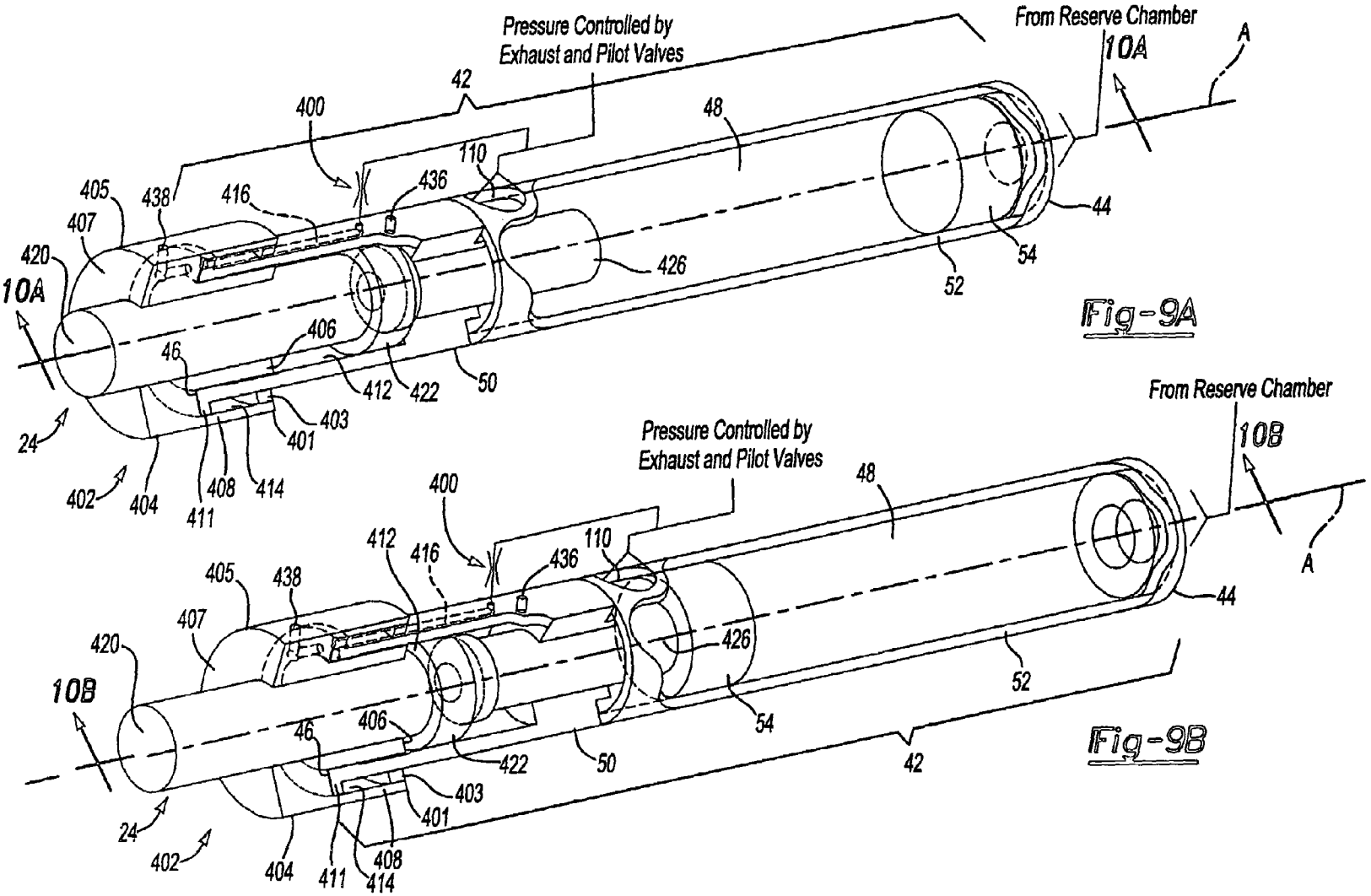
FIGS. 9A–9C are partially broken perspective views of an energy absorbing mechanism of the present invention illustrating three stages of the energy absorbing mechanism.
Figure 9C:
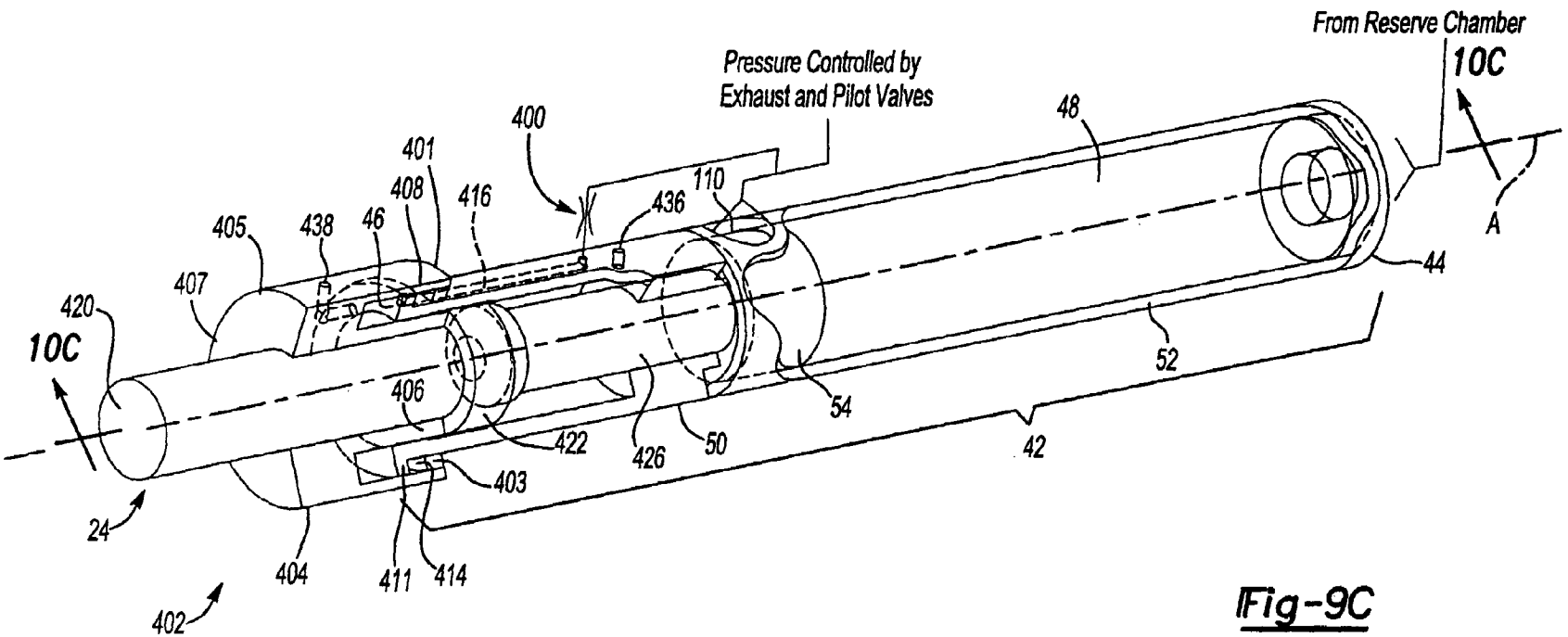

The power barrel 52 defines a fluid passage 416 for providing fluid communication between the first 412 and second 414 pressure chambers. A first end of the fluid passage 416 further includes the restrictor orifice 400 to restrict fluid flow into and out from the fluid passage 416. Referring to FIGS. 9A–9C, the restrictor orifice 400 is in direct fluid communication with the chamber 48 distally of the piston 54, such that as the chamber 48 is filled with pressurized fluid in the piston return cycle, the fluid passage 416 also pressurizes the pressure chambers 412, 414. Thus, the chamber 48 is a source of pressurized fluid that is connected to the first end of the fluid passage 416 to pressurize the first 412 and second 414 pressure chambers. Similarly, as the pressurized fluid is exhausted from the chamber 48 distally of the piston 54 upon actuation, pressurized fluid from the pressure chambers 412, 414 is slowly bled via the restrictor orifice 400.

The tool bit 24 and the piston 54 are independent and separable components and the piston 54 slides within the chamber 48 upon actuation of the exhaust valve 100 to impact the tool bit 24 and drive the tool bit 24 into the workpiece 22. The tool barrel 50 and the sleeve 404 define a bleed passage 418 (see FIG. 10D) therebetween whereby the tool bit 24 compresses the fluid out from the first pressure chamber 412 through the bleed passage 418 and fluid passage 416 and into the second pressure chamber 414 after the tool bit 24 begins to travel distally upon impact by the piston 54.

Preferably, the tool bit 24 comprises a bit 420 having a head 422 and a ram 426 for impacting the head 422 of the bit 420. The tool barrel 50 includes proximal and distal ends and the tool barrel 50 defines a bore in the proximal end for slidably and concentrically receiving and supporting the ram 426. An impact chamber is defined between the proximal end of the tool barrel 50 and the head 422. The ram 426 impacts the head 422 of the bit 420 within the impact chamber. The fluid in the first pressure chamber 412 is compressed and bleeds into the second pressure chamber 414 as the head 422 of the bit 420 slides distally within the impact chamber.

A vent port 436 is defined within the tool barrel 50 to prevent a vacuum in the impact chamber when the bit 420 is driven distally by the ram 426. A vent port 438 is defined within the sleeve 404 to prevent a vacuum between the sleeve 404 and the tool barrel 50 as the sleeve 404 sealably slides along the tool barrel 50 to reduce the kinetic energy of the tool bit 24.

In FIGS. 9A–9C and 10A–10C, the proximal end 44 of the casing 42, which normally includes the bleeder valve 300 previously described, instead illustrates a conventional end cap. This is for illustrative purposes only. This end cap is shown as defining an orifice for receiving the pressurized fluid from the reserve chamber 58. See FIGS. 2A–2B. Thus, the fluid circuits illustrated in FIGS. 9A–9C and 10A–10C are generically illustrated to show the operation of the energy absorbing mechanism 402. In actual operation, the bleeder valve 300 would be positioned in the power barrel 52 at the proximal end 44 and a port would provide fluid communication with the reserve chamber 58, as shown in FIGS. 6A–6C.

Figure 10A:
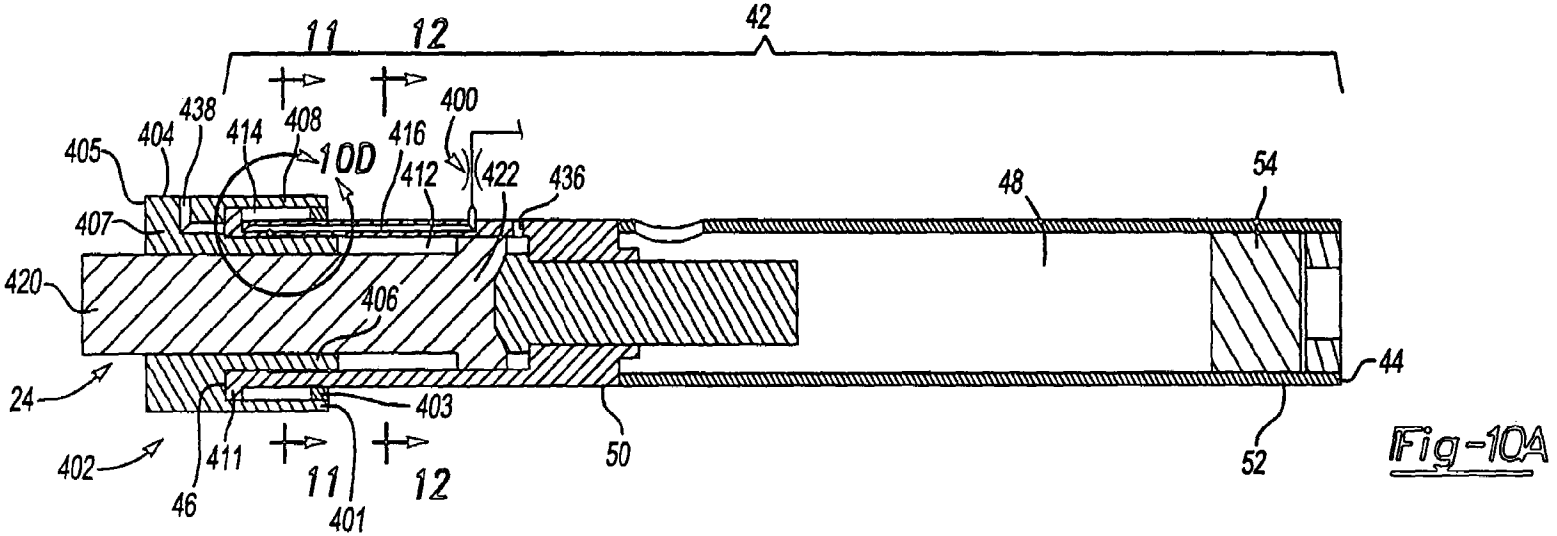
FIGS. 10A–10C are cross-sectional views of the energy absorbing mechanism from FIGS. 9A–9C illustrating the three stages of the energy absorbing mechanism.

In an initial stage, illustrated in FIGS. 9A and 10A, the fluid passage 416 and the pressure chambers 412, 414 are provided with pressurized fluid from the chamber 48 distally of the piston 54 via the distribution manifold 62 as controlled by the exhaust valve 100 and the pilot valve 200, while the fluid proximal to the piston 54, is provided by the reserve chamber 58 at a pressure less than the pressure of the fluid distal to the piston 54. Hence, the piston 54 is latched to the proximal end 44 of the casing 42 and the tool bit 24 is in the starting position.

Figure 10B:
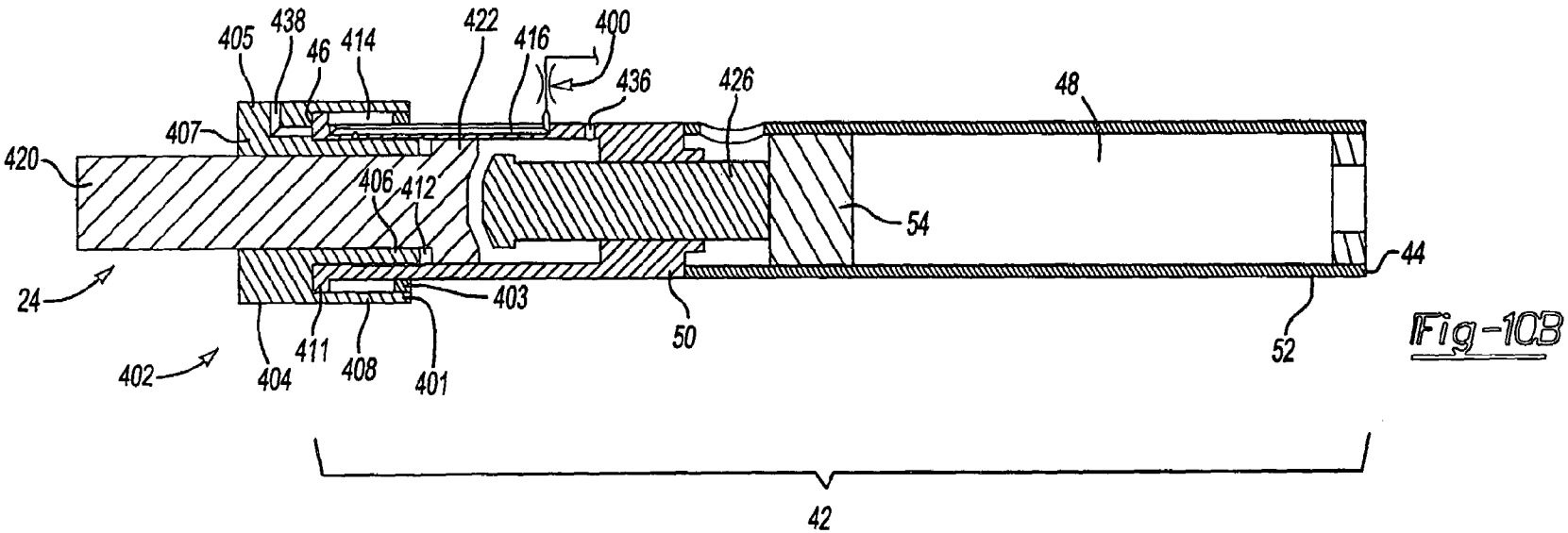

In a second stage, illustrated in FIGS. 9B and 10B, the pressurized fluid in the chamber 48 distal to the piston 54 has been released to the atmosphere. The piston 54 has impacted the tool bit 24 sending the bit 420 toward the sleeve 404 thus compressing the fluid in the first pressure chamber 412. As the fluid in the first pressure chamber 412 is further compressed, the fluid bleeds into the second pressure chamber 414 via the bleed passage 418 and the fluid passage 416. Pressurized fluid is also slowly released to the atmosphere via the restrictor orifice 400. In this stage, the process of fluid compression and release dissipates some of the bit's kinetic energy, roughly inversely proportional to a volume contraction of the first pressure chamber 412.

Figure 10C:
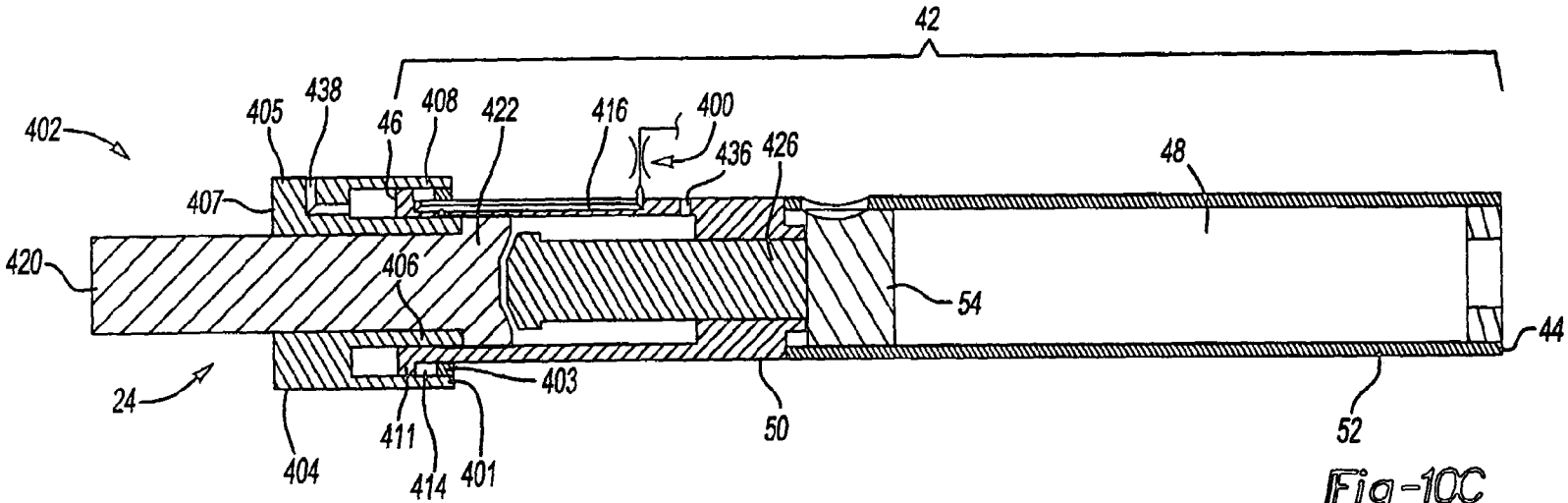
Figure 12:
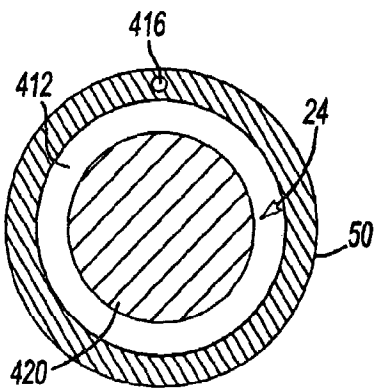
FIGS. 11–12 are cross-sectional views of the energy absorbing mechanism taken generally along the lines 11—11 and 12—12 respectively of FIG. 10A.
Figure 11:
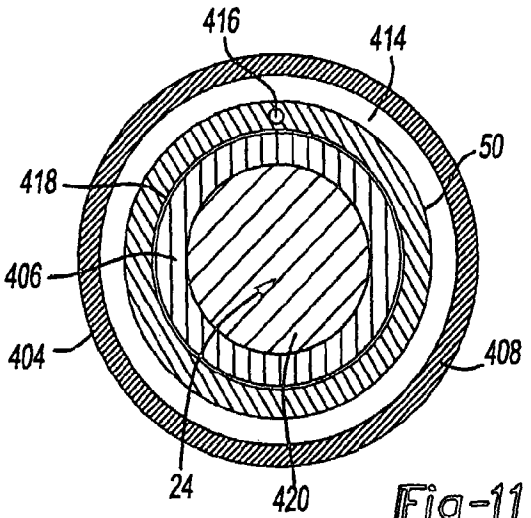
Figure 10D:
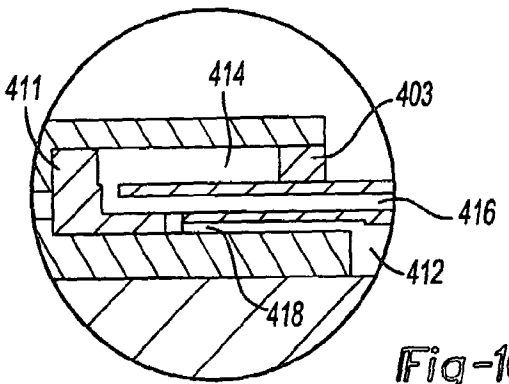
FIG. 10D is a blown-up view of a bleed passage.

In a final stage, illustrated in FIGS. 9C and 10C, the bit 420 has impacted the sleeve 404 and fully compressed the first pressure chamber 412. The sleeve 404 slides along the tool barrel 50 and compresses the second pressure chamber 414. At the same time, additional pressurized fluid is released from the second pressure chamber 414, through the fluid passage 416 and the restrictor orifice 400. Hence, with the slow bleed of pressurized fluid from the restrictor orifice 400, the first 412 and second 414 pressure chambers partially absorb the kinetic energy imparted to the bit 420 by the piston 54 and ram 426, while at the same time bleeding the kinetic energy via the restrictor orifice 400. In this stage, the process of fluid compression and release dissipates more of the bit's kinetic energy, roughly inversely proportional to a volume contraction of the second pressure chamber 414.

The piston 54, sleeve 404, ram 426, and bit 420 are very high strength, hardened, alloy steels, capable of interacting in a chain of energetic, almost perfectly elastic collisions. They are sized and configured, in conformance with conservation of linear momentum and fluid dynamics principles, to yield a desired balance between transfer and dissipation of kinetic energy. The collision chain shown here is not meant as a limiting configuration.

The fluid passage 416 and restrictor orifice 400 are sized and configured to produce desired rates of deceleration and energy dissipation. In alternative embodiments, the restrictor orifice 400 may be closed to outflow by a checkvalve (not shown).

With reference to FIGS. 13A–13C and 14, the shock absorbing valve 500 is further described. A floating collar 502 is slidably and concentrically coupled to the power barrel 52 between two seal rings 504 fixably and sealably concentric about the power barrel 52 so as to oppose each other. First 506 and second 508 annular envelopes are defined between the floating collar 502, the seal rings 504, and the power barrel 52. The floating collar 502 is cylindrical with a first section 510 sealably and slidably concentric around the power barrel 52 with an abutting, larger diameter section 512 at either end sealably and slidably concentric around the seal rings 504. The handle 34 is mounted to the floating collar 502, as described further below.

Figure 14:
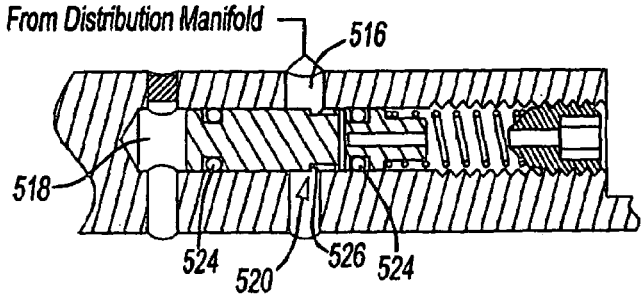
FIG. 14 is a cross-sectional view of a pressure regulator of the shock absorbing valve.

A manifold passage 514 is defined in the floating collar 502. A first port 516 is bored in the floating collar 502 to access the manifold passage 514. A restrictor passage 518 having a pressure regulator 520 therein regulates the flow of pressurized fluid into the manifold passage 514 from the distribution manifold 62 in accordance with well-known principles of pressure regulation. The pressure regulator 520 is adjustable to tune the tool 20 to correspond to multiple pressure rates from the pressurized fluid source F. Referring specifically to FIG. 14, the pressure regulator 520 is a cylindrical, lightweight, and corrosion-free body formed preferably from acetal, that is sealably and slidably concentric in the restrictor passage 518. The pressure regulator 520 has grooves for seals 524 and a bleed passage 526 for regulating the pressure in the shock absorbing valve 500.

Referring back to FIG. 13A, a pair of angled fluid passages 528 provides fluid communication between the manifold passage 514 and the annular envelopes 506, 508. A first 530 and second 532 pair of exhaust ports release pressurized fluid from the first 506 and second 508 envelopes to the atmosphere, respectively, upon actuation of the shock absorbing valve 500.

Figure 13A:
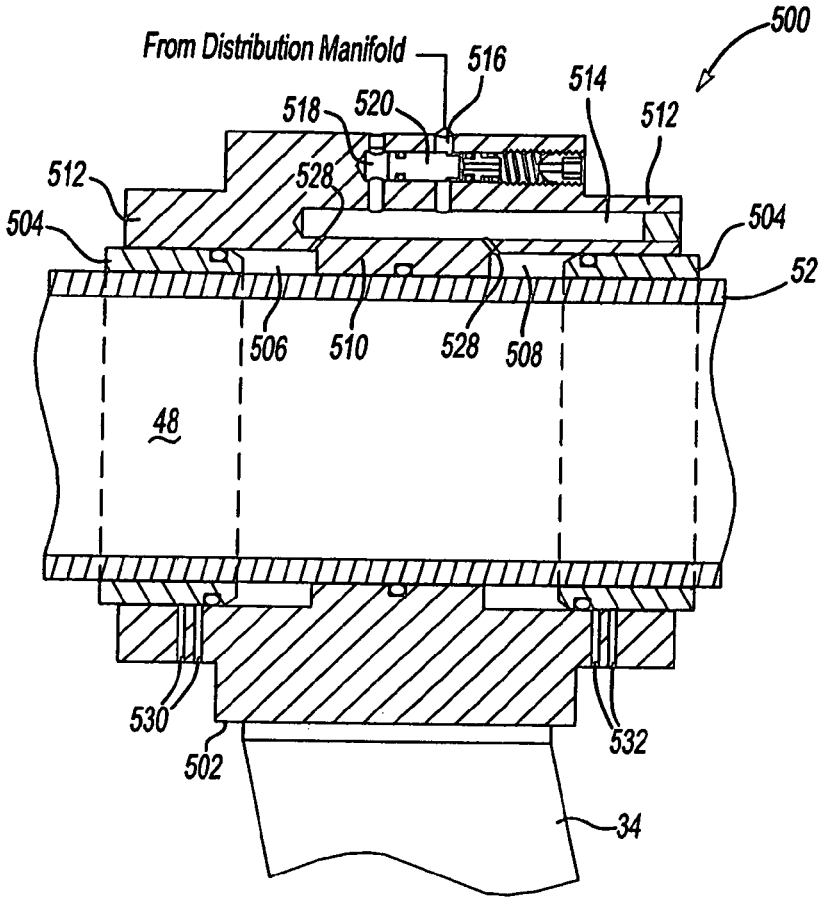
FIGS. 13A–13C are cross-sectional views of a shock absorbing valve of the present invention illustrating three stages of the shock absorbing valve.

In an initial stage, illustrated in FIG. 13A, the floating collar 502 rests in equilibrium, with the first 506 and second 508 envelopes being at equilibrium with one another until a force, e.g., recoil from acceleration of the piston 54 in the chamber 48, displaces the floating collar 502, compressing one of the envelopes 506, 508 and expanding the other, raising the pressure in the former and lowering the pressure in the latter.

Figure 13B:
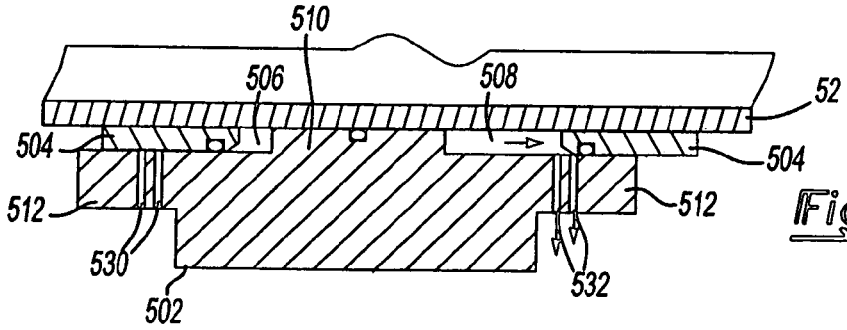

In a second stage, illustrated in FIG. 13B, displacement of the floating collar 502 vents the second envelope 508 to the atmosphere via the second pair 532 of exhaust ports. In this stage, the floating collar 502 is shown being displaced distally relative to the seal rings 504. This lowers the pressure in the second envelope 508 while increasing the pressure in the first envelope 506.

Figure 13C:
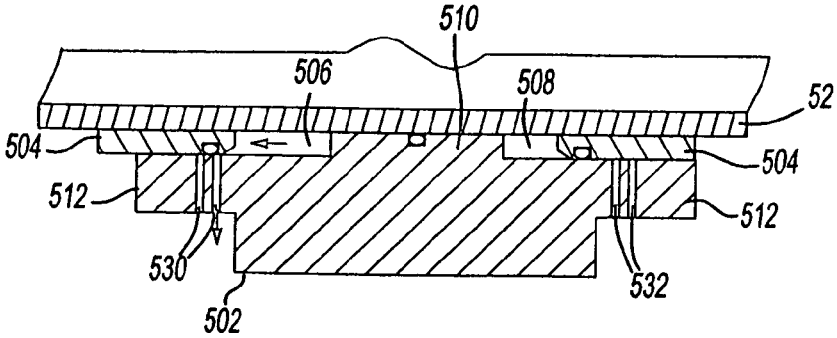

In a final stage, illustrated in FIG. 13C, the floating collar 502, under the pressure in the first envelope 506 slides back proximally relative to the power barrel 52. Thus, the pressure changes in the first 506 and second 508 envelopes via the pressurizing fluid supplied by the manifold passage 514 and the release of the pressurized fluid via the exhaust ports 530, 532, absorbs recoil of the tool 20 during use by striving to reach an equilibrium pressure condition within the envelopes 506, 508.

Figure 15:
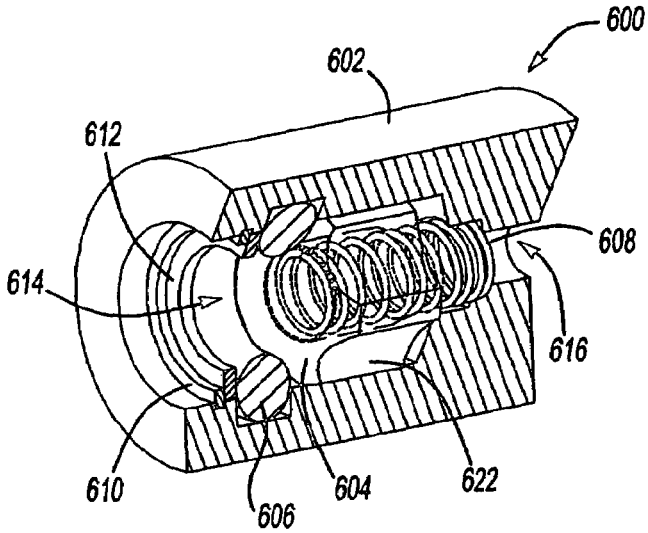
FIG. 15 is a partially broken perspective view of a pressure reducing check valve of the present invention.
Figure 16:
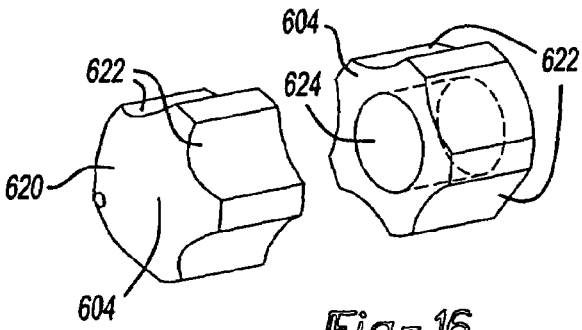
FIG. 16 is a front and rear perspective view of a poppet body of the pressure reducing check valve of FIG. 15.

With reference to FIGS. 15 and 16, the pressure reducing check valve 600 is further described. The pressure reducing check valve 600 is a tight-sealing, pressure-reducing check valve. The check valve 600 is designed to provide quick response and high-flow capacity to be easily integrated into the tool 20. The check valve 600 can be adjusted to provide a pressure reduction of a few pounds per square inch up to twenty pounds per square inch or more. The check valve 600 is used to isolate the reserve chamber 58 to facilitate high-efficiency design. The check valve 600 comprises a valve housing 602, a poppet body 604, a poppet seal 606, a spring 608, a retainer 610, and a seat washer 612.

The valve housing 602 is solid with a cylindrical cavity having an inlet 614 and outlet 616 passage and grooves to retain the poppet seal 606 and retainer 610. Referring briefly to FIG. 16, the poppet body 604 is a cylindrical lightweight solid with a rounded conical nose 620, a number of concave front-to-back, parallel-to-axis, airflow grooves 622, and a spring cavity 624 defining a back end. The poppet seal 606 is an elastic solid to provide a seat for the poppet body 604 to seal against and restrict flow at a desired pressure drop. The seat washer 612 and retainer 610 provide for retention of the poppet seal 606. The spring 608 is a compression spring configured to provide proper force and travel for desired valve cracking and opening characteristics. A spring shim washer adjusts spring compression to the desired cracking pressure differential (pressure reduction).

In operation, the spring 608 and pressurized fluid downstream of the check valve 600 seals the poppet body 604 to close flow until the downstream pressure drops below the cracking pressure. Upstream pressure then forces the poppet body 604 away from the poppet seal 606 and flow proceeds via the airflow grooves 622 as downstream conditions dictate. Using a lightweight solid to minimize latency, the poppet body 604 can be configured with a nose angle, length to diameter ratio, groove cross-sectional area and spring rate/travel so as to provide very responsive cracking and high-flow characteristics in a very compact size.

Figure 17:
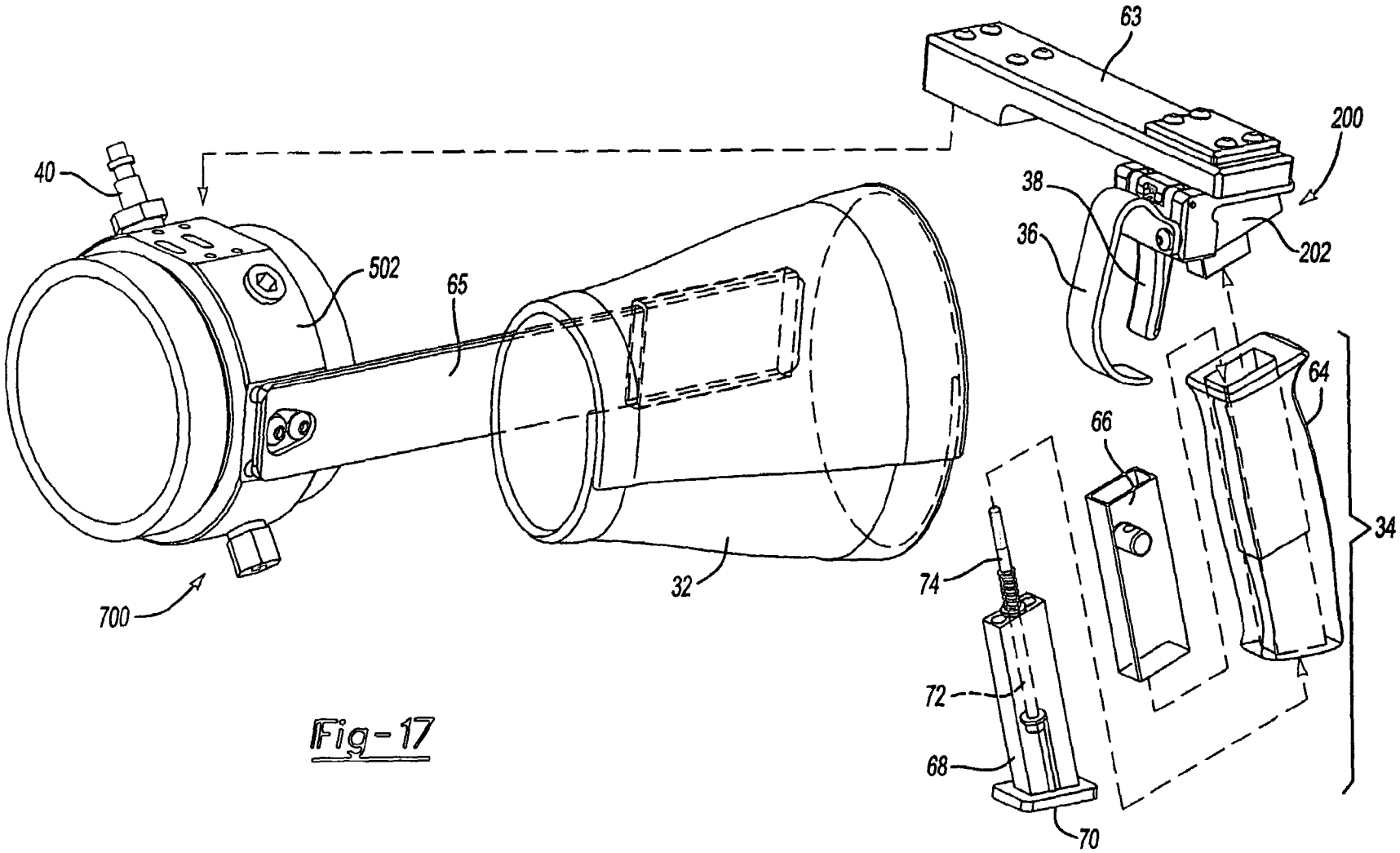
FIG. 17 is an assembly view of a floating collar, mounting arm, cuff, and handle of the present invention.

Referring to FIG. 17, a mounting arm 63 mounts the handle 34 to the floating collar 502 and a mounting bracket 65 mounts the cuff 32 to the floating collar 502. The mounting arm 63 is rectangular and solid with appropriate passages and attachments or fasteners to position the handle 34 in alignment with the cuff 32 and trigger 38. The mounting arm 63 bridges the handle 34 and the floating collar 502.

The handle 34 comprises a grip sleeve 64 that is rectangular and made from elastomeric, pliable material, having exterior contours ergonomically conformable to the hand of the operator. A grip core tube 66 tightly slip fits into the grip sleeve 64. A floating grip core retainer 68 slides into an underside of the grip sleeve 64. The floating grip core retainer 68 is rectangular and includes a flange 70 at a bottom end with a fluid passage 72 therethrough. A spring-loaded fastener 74 is sized to fit slidably into the grip core tube 66 and the grip sleeve 64 so as to retain them on the valve housing 202 of the pilot valve 200 in a manner forgiving to flexing or accidental impact.

Figure 18:
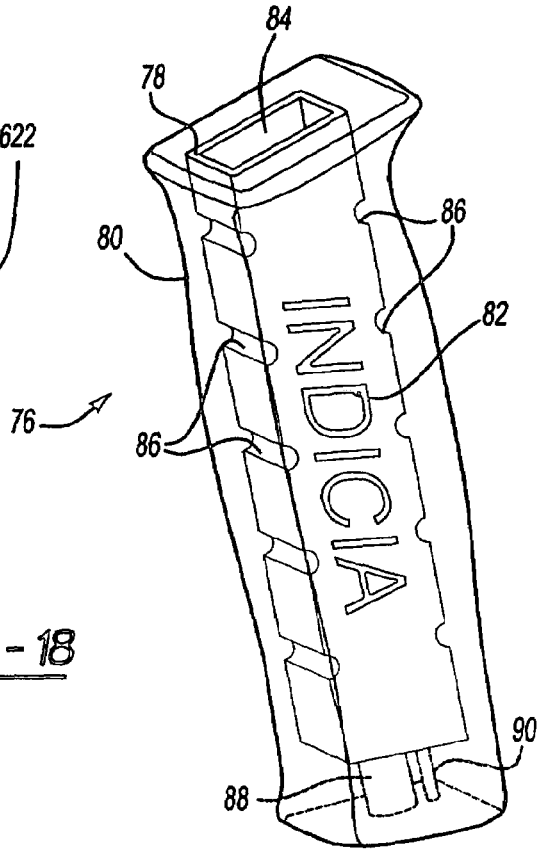
FIG. 18 is a perspective view of an alternative handle of the tool.

An alternative handle 76 is shown in FIG. 18. The alternative handle 76 comprises a post 78 formed from metal that is fixed to either the valve housing 202 of the pilot valve 200 or other position on the mounting arm 63. A transparent elastomeric material is formed about the post 78 to form a grip 80. Indicia 82 is embossed, e.g., raised, on the post 78 such that the indicia 82 is visible to the operator through the grip 80 to create an aesthetically pleasing visual representation of the indicia. The indicia 82 may be integrally formed in the post 78 or may be a separate component fixed to the post 78. In alternative embodiments, the indicia 82 is not raised, but is merely printed on the post 78, or comprises a sticker affixed to the post 78. The post 78 is generally rectangular in shape and includes a hollow cavity 84 for mounting the handle 76 to the tool 20. The post 78 also defines a plurality of grooves 86 for further securing the grip 80 to the post 78. The handle 76 includes a first bore 88 extending longitudinally therethrough at a generally central position to mount the handle 76 to the tool 20 via a fastener (not shown). The handle 76 also includes a second bore 90 extending longitudinally therethrough adjacent to the first bore 88. The second bore 90 provides an exhaust passage for exhausting pressurized fluid from the third port 212 of the pilot valve 200 to the atmosphere.

The tool 20 is an integration of innovative features and components, including valving, kinetic energy generation/transfer and ergonomics. The tool 20 comprises a series of concentric cylindrical envelopes and cylinders, with integrated or attached fluid flow control circuitry and components, operating in a very efficient single-stroke mode, developing high power in a very compact, lightweight and maneuverable form. The tool 20 produces high-energy, high-acceleration impacts and delivers them with a long-excursion transfer/tool bit assembly capable of dry firing without damaging tool components. The tool 20 embodies an operator interface innovation that features a dynamic fluid-flow recoil damping system coupled to a forgiving cuff/handle configuration that makes the tool 20 a virtual extension of the operator's arm and hand, enabling very comfortable, low-shock, and nimble, one hand operation.

Obviously, many modifications and variations of the present invention are possible in light of the above teachings. The invention may be practiced otherwise than as specifically described within the scope of the appended claims. In addition, the reference numerals in the claims are merely for convenience and are not to be read in any way as limiting.

What is claimed is:

1. A tool (20) for impacting a workpiece (22), comprising;

a casing (42) having a proximal end (44) and a distal end (46) and defining a chamber (48) therebetween, an impactor device (24, 54) slidable within said chamber (48) to impact the workpiece, and a shock absorbing valve (500) including a floating collar (502) slidably coupled to said casing (42) to define first (506) and second (508) fluid envelopes between said floating collar (502) and said casing (42) for receiving pressurized fluid, said floating collar (502) defining at least one first exhaust port (530) in selective fluid communication with said first fluid envelope (506) and at least one second exhaust port (532) in selective fluid communication with said second fluid envelope (508) whereby said exhaust ports (530, 532) alternate in reducing pressure in said fluid envelopes (506, 508) as said floating collar (502) slides along said casing (42) to reduce shock to a user of said tool (20) while said impactor device (24, 54) impacts the workpiece.

2. A tool as set forth in claim 1 wherein said floating collar (502) is slidable along said casing (42) between a first position in which said at least one first exhaust port (530) is in fluid communication with said first fluid envelope (506) to expose said first fluid envelope (506) to atmosphere and said at least one second exhaust port (532) is closed from fluid communication with said second fluid envelope (508) and a second position in which said at least one first exhaust port (530) is closed from fluid communication with said first fluid envelope (506) and said at least one second exhaust port (532) is in fluid communication with said second fluid envelope (508) to expose said second fluid envelope (508) to atmosphere whereby alternating exposure of said fluid envelopes (506, 508) to atmosphere increases a pressure differential between said fluid envelopes (506, 508) thereby urging said floating collar (502) to an equilibrium position.

3. A tool as set forth in claim 1 wherein said floating collar (502) further defines a passage (518) in fluid communication with said fluid envelopes (506, 508) with a pressure regulator (520) disposed in said passage (518) for regulating flow of pressurized fluid into said fluid envelopes (506, 508).

4. A tool as set forth in claim 3 wherein said pressure regulator (520) is adjustable for tuning said tool (20) to multiple pressure rates.

5. A tool as set forth in claim 4 wherein said pressure regulator (520) comprises a cylindrical body formed from acetal.

6. A tool as set forth in claim 1 wherein said at least one first exhaust port (530) is further defined as a plurality of first exhaust ports (530) and said at least one second exhaust port (532) is further defined as a plurality of second exhaust ports (532).

7. A tool as set forth in claim 1 including a first seal ring (504) fixed to said casing (42) and a second seal ring seal (504) fixed to said casing (42) and spaced from said first seal ring (504) wherein said floating collar (502) is slidably coupled to said casing (42) about said seal rings (504) and said annular envelopes (506, 508) are defined between said floating collar (502), said seal rings (504), and said casing (42).

8. A tool as set forth in claim 1 including a valve system (100, 200) for selectively introducing and releasing pressurized fluid into and out from said chamber (48) to slide said impactor device (24, 54) within said chamber (48) along said operational axis (A).

9. A tool as set forth in claim 8 further including an energy absorbing mechanism (402) having a sleeve (404) slidable along said distal end (46) of said casing (42) to define a first pressure chamber (412) with said impactor device (24, 54) for reducing the kinetic energy of said impactor device (24, 54) in a first stage immediately after movement thereof by compressing pressurized fluid within said first pressure chamber (412).

10. A tool as set forth in claim 9 wherein said energy absorbing mechanism (402) further comprises a second pressure chamber (414) defined between said casing (42) and said sleeve (404) for reducing the kinetic energy of said impactor device (24, 54) in a second stage by compressing pressurized fluid within said second pressure chamber (414) after compressing the pressurized fluid in said first pressure chamber (412) when said impactor device (24, 54) impacts said sleeve (404).

11. A tool as set forth in claim 8 wherein said valve system (100, 200) comprises an exhaust valve (100) having a valve housing (102) concentrically surrounding said casing (42) and a sliding sleeve (108) for sliding between said casing (42) and said valve housing (102) to expose ports (110) defined annularly about said casing (42) and release pressurized fluid within said chamber (48) to atmosphere.

12. A tool as set forth in claim 11 wherein said valve system (100, 200) further comprises a pilot valve (200) having a valve housing (202) and a plunger (206) slidable within said valve housing (202) for selectively introducing pressurized fluid into and out from said chamber (48) by controlling said exhaust valve (100).

13. A tool as set forth in claim 1 including a handle (34) mounted to said floating collar (502) for grasping by the user.

14. A shock absorbing valve (500) for a tool (20) having a casing (42) defining a chamber (42) and an impactor device (24, 54) slidable within the chamber (48) to impact a workpiece (22), said valve comprising;

a floating collar (502) for slidably coupling to said casing (42) to define first (506) and second (508) fluid envelopes between said floating collar (502) and the casing (42) for receiving pressurized fluid, said floating collar (502) defining at least one first exhaust port (530) in selective fluid communication with the first (506) fluid envelope and at least one second exhaust port (532) in selective fluid communication with the second (508) fluid envelope whereby said exhaust ports (530, 532) alternate in reducing pressure in the fluid envelopes (506, 508) as said floating collar (502) slides along the casing (42) to reduce shock to a user of the tool (20) while the impactor device (24, 54) impacts the workpiece.

15. A tool as set forth in claim 14 wherein said floating collar (502) is adapted for sliding along said casing (42) between a first position in which said at least one first exhaust port (530) is in fluid communication with the first fluid envelope (506) to expose the first fluid envelope (506) to atmosphere and said at least one second exhaust port (532) is closed from fluid communication with the second fluid envelope (508) and a second position in which said at least one first exhaust port (530) is closed from fluid communication with the first fluid envelope (506) and said at least one second exhaust port (532) is in fluid communication with the second fluid envelope (508) to expose the second fluid envelope (508) to atmosphere whereby alternating exposure of the fluid envelopes (506, 508) to atmosphere increases a pressure differential between the fluid envelopes (506, 508) thereby urging said floating collar (502) to an equilibrium position.

16. A valve as set forth in claim 15 wherein said floating collar (502) further defines a passage (518) for being in fluid communication with the fluid envelopes (506, 508) with a pressure regulator (520) disposed in said passage (518) for regulating flow of pressurized fluid into the fluid envelopes (506, 508).

17. A valve as set forth in claim 16 wherein said pressure regulator (520) is adjustable.

18. A valve as set forth in claim 16 wherein said pressure regulator (520) comprises a cylindrical body formed from acetal.

19. A valve as set forth in claim 14 wherein said at least one first exhaust port (530) is further defined as a plurality of first exhaust ports (530) and said at least one second exhaust port (532) is further defined as a plurality of second exhaust ports (532).

20. A valve as set forth in claim 14 including a first seal ring (504) for fixing to the casing (42) and a second seal ring seal (504) for fixing to the casing (42) at a position spaced from said first seal ring (504) wherein said floating collar (502) is adapted for slidably coupling to said casing (42) about said seal rings (504) such that the annular envelopes (506, 508) are defined between said floating collar (502), said seal rings (504), and the casing (42).

21. A valve as set forth in claim 14 including a handle (34) mounted to said floating collar (502) for grasping by the user.

* * * * *